US009976102B2

(12) United States Patent
Waynick

(10) Patent No.: US 9,976,102 B2
(45) Date of Patent: May 22, 2018

(54) COMPOSITION AND METHOD OF MANUFACTURING CALCIUM SULFONATE GREASES USING ALKALI METAL HYDROXIDE AND DELAYED ADDITION OF NON-AQUEOUS CONVERTING AGENTS

(71) Applicant: NCH Corporation, Irving, TX (US)

(72) Inventor: John A. Waynick, Lantana, TX (US)

(73) Assignee: NCH Corporation, Irving, TX (US)

( * ) Notice: Subject to any disclaimer, the term of this patent is extended or adjusted under 35 U.S.C. 154(b) by 0 days. days.

(21) Appl. No.: 15/130,422

(22) Filed: Apr. 15, 2016

(65) Prior Publication Data

US 2016/0230112 A1 Aug. 11, 2016

Related U.S. Application Data

(63) Continuation-in-part of application No. 13/664,768, filed on Oct. 31, 2012, now Pat. No. 9,458,406, which is a continuation-in-part of application No. 14/990,473, filed on Jan. 7, 2016, which is a continuation-in-part of application No. 13/664,574, filed on Oct. 31, 2012, now Pat. No. 9,273,265.

(60) Provisional application No. 61/553,674, filed on Oct. 31, 2011.

(51) Int. Cl.

| | |
|---|---|
| ***C10M 169/04*** | (2006.01) |
| ***C07F 5/04*** | (2006.01) |
| ***C10M 159/20*** | (2006.01) |
| ***C10M 163/00*** | (2006.01) |
| ***C10M 121/04*** | (2006.01) |
| ***C10M 159/24*** | (2006.01) |

(52) U.S. Cl.

CPC ..... *C10M 121/04* (2013.01); *C10M 159/24* (2013.01); *C10N 2210/01* (2013.01); *C10N 2210/02* (2013.01); *C10N 2230/08* (2013.01); *C10N 2230/52* (2013.01); *C10N 2250/10* (2013.01); *C10N 2270/00* (2013.01)

(58) Field of Classification Search

CPC .. C10M 113/04; C10M 115/10; C10M 113/10
USPC ..... 508/162, 336, 391, 180
See application file for complete search history.

(56) References Cited

U.S. PATENT DOCUMENTS

| | | | |
|---|---|---|---|
| 2,270,577 | A | 1/1942 | Bergstrom |
| 2,402,325 | A | 6/1946 | Griesinger |
| 2,418,894 | A | 4/1947 | McNab |
| 2,444,970 | A | 7/1948 | Zimmer |
| 2,485,561 | A | 10/1949 | Campbell |
| 2,501,731 | A | 3/1950 | Mertes |
| 2,535,101 | A | 12/1950 | Sproule |
| 2,540,533 | A | 2/1951 | Kolfenbach |
| 2,585,520 | A | 2/1952 | Van Ess |
| 2,616,904 | A | 11/1952 | Asseff |
| 2,616,905 | A | 11/1952 | Asseff |
| 2,616,906 | A | 11/1952 | Asseff |
| 2,616,911 | A | 11/1952 | Asseff |
| 2,616,924 | A | 11/1952 | Asseff |
| 2,616,925 | A | 11/1952 | Asseff |
| 2,617,049 | A | 11/1952 | Asseff |
| 2,695,910 | A | 11/1954 | Asseff |
| 2,723,235 | A | 11/1955 | Asseff |
| 2,839,470 | A | 6/1958 | Warren |
| 2,861,951 | A | 11/1958 | Carlyle |
| 2,865,956 | A | 12/1958 | Ellis |
| 2,898,296 | A | 8/1959 | Pattenden et al. |
| 2,920,105 | A | 1/1960 | Kluge |
| 2,937,991 | A | 5/1960 | Carlyle |
| 2,940,930 | A | 6/1960 | Pattenden et al. |
| 2,956,018 | A | 10/1960 | Carlyle |
| 2,967,151 | A | 1/1961 | Morway |
| 2,977,301 | A | 3/1961 | Bergen |

(Continued)

FOREIGN PATENT DOCUMENTS

| | | |
|---|---|---|
| CN | 101153239 | 4/2008 |
| CN | 101993767 | 3/2011 |

(Continued)

OTHER PUBLICATIONS

Kobylyanskli, E.V., Structure of Ultrabasic Sulfonate Greases:, Chem. and Tech. of Fuels and Oils, 2002, 38(2).

(Continued)

*Primary Examiner* — Prem C Singh
*Assistant Examiner* — Frank C Campanell
(74) *Attorney, Agent, or Firm* — Ross Barnes LLP; Robin L. Barnes

(57) ABSTRACT

An overbased calcium sulfonate grease composition and method of manufacture comprising added alkali metal hydroxide alone or in combination with (a) calcium hydroxyapatite and/or added calcium carbonate used as calcium containing bases for reacting with complexing acids) and/or (b) at least one delay period between the addition of water as a converting agent and addition of a portion of a non-aqueous converting agent. A delay period may involve the period of time it takes to adjust the temperature of the mixture, a period of time during which the mixture is held at a temperature or within a range of temperatures, and multiples and any combination thereof. These calcium sulfonate greases have improved thickener yield and high dropping points compared to greases made without added alkali metal hydroxide and delay between the additions of water and a non-aqueous converting agent, particularly when a poor quality overbased calcium sulfonate is used.

35 Claims, No Drawings

(56) References Cited

U.S. PATENT DOCUMENTS

| | | | | |
|---|---|---|---|---|
| 2,978,410 | A | 4/1961 | Fullerton | |
| 3,027,325 | A | 3/1962 | McMillen | |
| 3,057,896 | A | 10/1962 | Schlight et al. | |
| 3,150,088 | A | 9/1964 | Hunt et al. | |
| 3,186,944 | A | 6/1965 | Dreher | |
| 3,242,079 | A | 3/1966 | McMillen | |
| 3,372,115 | A | 3/1968 | McMillen | |
| 3,376,222 | A | 4/1968 | McMillen | |
| 3,377,283 | A | 4/1968 | McMillen | |
| 3,492,231 | A | 1/1970 | McMillen | |
| 3,537,996 | A | 11/1970 | Holst | |
| 3,655,558 | A | 4/1972 | Geyer et al. | |
| 3,661,622 | A | 5/1972 | Rogers | |
| 3,671,012 | A | 6/1972 | Scott | |
| 3,679,584 | A | 7/1972 | Hellmuth | |
| 3,681,242 | A | 8/1972 | Gilani et al. | |
| 3,746,643 | A | 7/1973 | Rogers | |
| 3,791,973 | A | 2/1974 | Gilani et al. | |
| 3,816,310 | A | 6/1974 | Hunt | |
| 3,850,823 | A | 11/1974 | Kjonaas | |
| 3,907,691 | A | 9/1975 | King et al. | |
| 3,929,650 | A | 12/1975 | King et al. | |
| 3,940,339 | A | 2/1976 | Clarke, Jr. et al. | |
| 4,297,227 | A | 10/1981 | Witte et al. | |
| 4,376,060 | A | 3/1983 | Stadler | |
| 4,435,299 | A | 3/1984 | Carley et al. | |
| 4,444,669 | A | 4/1984 | Wittse, Jr. et al. | |
| 4,483,775 | A | 11/1984 | Yamaguchi | |
| 4,560,489 | A | 12/1985 | Muir | |
| 4,597,880 | A | 7/1986 | Eliades | |
| 4,728,578 | A | 3/1988 | Higgins et al. | |
| 4,744,920 | A | 5/1988 | Fischer et al. | |
| 4,780,224 | A | 10/1988 | Jao | |
| 4,787,992 | A | 11/1988 | Waynick | |
| 4,810,396 | A | 3/1989 | Jao et al. | |
| 4,810,398 | A | 3/1989 | Van Kruchten et al. | |
| 4,824,584 | A | 4/1989 | Muir | |
| 4,830,767 | A | 5/1989 | Waynick | |
| 4,902,435 | A | 2/1990 | Waynick | |
| 4,904,399 | A | 2/1990 | Waynick | |
| 4,929,371 | A | 5/1990 | Waynick | |
| 5,084,193 | A | 1/1992 | Waynick | |
| 5,126,062 | A | 6/1992 | Barnes | |
| 5,190,678 | A | 3/1993 | Swartz | |
| 5,308,514 | A | 5/1994 | Olson | |
| 5,338,467 | A * | 8/1994 | Olson | C10M 121/00 508/186 |
| 6,172,122 | B1 | 1/2001 | Lawate et al. | |
| 6,239,083 | B1 | 5/2001 | Muir | |
| 6,432,889 | B1 | 8/2002 | Kinoshita et al. | |
| 6,534,450 | B1 | 3/2003 | Harrison | |
| 6,596,672 | B1 | 7/2003 | Carrick et al. | |
| 6,869,111 | B2 | 3/2005 | Goto et al. | |
| 6,875,731 | B1 * | 4/2005 | Bence | C10M 159/24 508/391 |
| 7,241,723 | B2 | 7/2007 | Zhang | |
| 7,294,608 | B2 | 11/2007 | Oldiges | |
| 7,517,837 | B2 | 4/2009 | Kurosky et al. | |
| 2003/0111838 | A1 | 6/2003 | Goto et al. | |
| 2005/0054541 | A1 * | 3/2005 | Zhang | C10M 169/06 508/180 |
| 2005/0215442 | A1 | 9/2005 | Sivik et al. | |
| 2006/0025317 | A1 | 2/2006 | Olson et al. | |
| 2006/0223719 | A1 | 10/2006 | Riff et al. | |
| 2007/0060485 | A1 | 3/2007 | Waynick | |
| 2009/0305920 | A1 | 12/2009 | Kato et al. | |
| 2011/0021391 | A1 | 1/2011 | E et al. | |
| 2011/0048809 | A1 | 3/2011 | Duckworth | |
| 2011/0092404 | A1 | 4/2011 | Zhang et al. | |
| 2011/0136709 | A1 | 6/2011 | Tanaka et al. | |
| 2011/0160105 | A1 | 6/2011 | Tanaka et al. | |
| 2011/0190177 | A1 | 8/2011 | Zaki | |
| 2011/0195880 | A1 | 8/2011 | Kawamura et al. | |
| 2011/0233473 | A1 | 9/2011 | Fletcher | |
| 2013/0109602 | A1 | 5/2013 | Waynick | |
| 2014/0121139 | A1 | 5/2014 | Waynick | |

FOREIGN PATENT DOCUMENTS

| | | |
|---|---|---|
| CN | 102051257 | 5/2011 |
| CN | 102634400 | 8/2012 |
| CN | 103952215 | 7/2014 |
| CN | 104024162 | 9/2014 |
| GB | 816318 | 7/1959 |
| GB | 1239860 | 7/1971 |
| JP | 2004346120 | 12/2004 |
| JP | 2007084620 | 4/2007 |
| JP | 2009286950 | 12/2009 |
| JP | 2009292918 | 12/2009 |
| JP | 2009298890 | 12/2009 |
| WO | WO2011098616 | 8/2011 |

OTHER PUBLICATIONS

Boner, C.J. Manufacture and Application of Lubricating Greases, 1954, p. 369, Hafner Publishing Company, Inc.

* cited by examiner

COMPOSITION AND METHOD OF MANUFACTURING CALCIUM SULFONATE GREASES USING ALKALI METAL HYDROXIDE AND DELAYED ADDITION OF NON-AQUEOUS CONVERTING AGENTS

CROSS-REFERENCE TO RELATED APPLICATION

This application is a continuation-in-part of U.S. application Ser. No. 13/664,768 filed on Oct. 31, 2012, which claims the benefit of U.S. provisional patent application No. 61/553,674 filed on Oct. 31, 2011. This application is also a continuation-in-part of U.S. application Ser. No. 14/990,473, which is a continuation-in-part of U.S. application Ser. No. 13/664,768 filed on Oct. 31, 2012, which claims the benefit of U.S. provisional patent application No. 61/553,674 filed on Oct. 31, 2011 and is also a continuation-in-part of U.S. application Ser. No. 13/664,574 (now U.S. Pat. No. 9,273,265 issued on Mar. 1, 2016), which claims the benefit of U.S. provisional patent application No. 61/553,674 filed on Oct. 31, 2011.

BACKGROUND OF THE INVENTION

1. Field of the Invention

This invention relates to overbased calcium sulfonate greases made with the addition of an alkali metal hydroxide to provide improvements in both thickener yield and expected high temperature utility as demonstrated by dropping point, even when the oil-soluble overbased calcium sulfonate used to make the grease is considered to be of poor quality. This invention also related to overbased calcium sulfonate greases made with both added alkali metal hydroxide and delayed addition of non-aqueous converting agents.

2. Description of Related Art

Overbased calcium sulfonate greases have been an established grease category for many years. One known process for making such greases is a two-step process involving the steps of "promotion" and "conversion." Typically the first step ("promotion") is to react a stoichiometric excess amount of calcium oxide (CaO) or calcium hydroxide ($Ca(OH)_2$) as the base source with an alkyl benzene sulfonic acid, carbon dioxide ($CO_2$), and with other components to produce an oil-soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. For the purposes of this disclosure, the terms "overbased oil-soluble calcium sulfonate" and "oil-soluble overbased calcium sulfonate" and "overbased calcium sulfonate" refer to any overbased calcium sulfonate suitable for making calcium sulfonate greases.

Typically the second step ("conversion") is to add a converting agent or agents, such as propylene glycol, isopropyl alcohol, water, formic acid or acetic acid, to the product of the promotion step, along with a suitable base oil (such as mineral oil) if needed to keep the initial grease from being too hard, to convert the amorphous calcium carbonate contained in the overbased calcium sulfonate to a very finely divided dispersion of crystalline calcium carbonate (calcite). When acetic acid or other acids are used as a converting agent, typically water and another non-aqueous converting agent (a third converting agent, such as an alcohol) are also used; alternatively only water (without the third converting agent) is added, but the conversion then typically occurs in a pressurized vessel. Because an excess of calcium hydroxide or calcium oxide is used to achieve overbasing, a small amount of residual calcium oxide or calcium hydroxide may also be present as part of the oil soluble overbased calcium sulfonate and will be dispersed in the initial grease structure. The extremely finely divided calcium carbonate formed by conversion, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

It is also known in the prior art to combine these two steps, by carefully controlling the reaction, into a single step. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. This one-step process is disclosed, for example, in U.S. Pat. Nos. 3,661,622; 3,671,012; 3,746,643; and 3,816,310.

In addition to simple calcium sulfonate greases, calcium sulfonate complex greases are also known in the prior art. These complex greases are typically produced by adding a strong calcium-containing base, such as calcium hydroxide or calcium oxide, to the simple calcium sulfonate grease produced by either the two-step or one-step process and reacting with up to stoichiometrically equivalent amounts of complexing acids, such as 12-hydroxystearic acid, boric acid, acetic acid (which may also be a converting agent when added pre-conversion), or phosphoric acid. The claimed advantages of the calcium sulfonate complex grease over the simple grease include reduced tackiness, improved pumpability, and improved high temperature utility. Calcium sulfonate complex greases are disclosed, for example, in U.S. Pat. Nos. 4,560,489; 5,126,062; 5,308,514; and 5,338,467.

Much of the known prior art using the two step method teaches the addition of all converting agents (water and non-aqueous converting agents) at the same time and usually prior to heating. However, a few prior art references disclose a time interval (although always poorly defined or not defined at all) between the addition of water and the addition of at least part of the non-aqueous converting agent(s). For example, U.S. Pat. No. 4,560,489 discloses a process (examples 1-3) where base oil and overbased calcium carbonate are heated to around 150° F., then water is added, the mixture is then heated to around 190° F. before adding acetic acid and methyl Cellosolve (a highly toxic monomethylether of ethylene glycol). The resulting grease contains greater than 38% overbased calcium sulfonate and the '489 patent points out that the ideal amount of overbased calcium sulfonate for the processes disclosed therein is around 41-45%, since according to the '489 patent using less than 38% results in a soft grease. The resulting grease of example 1 in the '489 patent has a dropping point of around only 570° F. The '489 patent does not state the duration of delay between the addition of water and the addition of the non-aqueous converting agents, but indicates that the addition was immediate after a period of heating from 150 F to just 190 F. The dropping point and thickener yield in the '489 patent are not desirable.

Additionally, U.S. Pat. Nos. 5,338,467 and 5,308,514 disclose the use of a fatty acid, such as 12-hydroxystearic acid, as a converting agent used along with acetic acid and methanol, where there is no delay for the addition of the fatty acid but some interval between the addition of water and the addition of acetic acid and methanol. Example B in the '514 patent and example 1 in the '467 patent both describe a process where water and the fatty acid converting agent are added to other ingredients (including the overbased calcium sulfonate and base oil), then heated to around 140-145° F. before adding acetic acid followed by methanol. The mixture is then heated to around 150-160° F. until conversion is complete. The amount of overbased calcium sulfonate in the final grease products in both examples is 32.2, which is higher than desirable. These patents do not state the duration of delay between the addition of water and fatty acid and the addition of the acetic acid and methanol, but indicates that the addition was immediate after an unspecified period of heating. Similar processes are disclosed in example A of the '467 patent and example C of the '514 patent except all of the fatty acid was added post conversion, so the only non-aqueous converting agents used were the acetic acid and methanol added after the mixture with water was heated to 140-145 F. The amount of overbased calcium sulfonate in these examples is even higher than the previous examples at 40%. In addition to not achieving ideal thickener yield results, all these processes use methanol as a converting agent, which has environmental drawbacks. The use of volatile alcohols as converting agents may result in venting these ingredients to the atmosphere as a later part of the grease-making process, which is prohibited in many parts of the world. If not vented, the alcohols must be recovered by water scrubbing or water traps, which results in hazardous material disposal costs. As such, there is a need for a process that achieves better thickener yields, preferably without requiring the use of volatile alcohols as converting agents.

Better thickener yields are achieved in example 10 of the '514 patent, but the use of excess lime is taught as a requirement to achieve those results. In that example, water and excess lime are added together with other ingredients, the mixture is heated to 180-190 F while slowly adding acetic acid during the heating period. The resulting grease contained 23% overbased calcium sulfonate. While this thickener yield is better than others, there is still room for greater improvement without requiring the use of excess lime, which the '514 patent teaches as a requirement.

The other examples in '514 and '467 patents where there are thickener yields of 23% or less either involve the use of a pressurized kettle during conversion or are like the much greater part of the other prior art where there is no "delay" between the addition of water and the non-aqueous converting agents or both. These examples involve adding water and a fatty acid converting agent, mixing for 10 minutes without heating, and then adding acetic acid, either in a pressurized kettle or without pressure. Neither of these patents recognizes any benefit or advantage to the 10 minute interval for adding acetic acid, or the other heating delays in the examples discussed above, rather these patents focus the use of a fatty acid as a converting agent and the benefits of adding the fatty acid pre-conversion, post-conversion, or both as the reason for any observed yield improvements. Additionally, as discussed below, this 10 minute mixing interval without any heating is not a "delay" as that term is used herein, but is considered to be the same as adding the ingredients at the same time, recognizing that adding each ingredient takes at least some time and cannot occur instantaneously.

Additionally, the known prior art always teaches the use of calcium oxide or calcium hydroxide as the sources of basic calcium for production of calcium sulfonate greases or as a required component for reacting with complexing acids to form calcium sulfonate complex greases. The known prior art teaches that the addition of calcium hydroxide or calcium oxide needs to be in an amount sufficient (when added to the amount of calcium hydroxide or calcium oxide present in the overbased oil-soluble calcium sulfonate) to provide a total level of calcium hydroxide or calcium oxide sufficient to fully react with the complexing acids. As disclosed in co-pending U.S. application Ser. No. 13/664,768 ("the '768 application") and U.S. Pat. No. 9,273,265, the known prior art generally teaches that the presence of calcium carbonate (as a separate ingredient or as an "impurity" in the calcium hydroxide or calcium oxide, other than that presence of the amorphous calcium carbonate dispersed in the calcium sulfonate after carbonation), should be avoided for at least two reasons. The first being that calcium carbonate, is generally considered to be a weak base, unsuitable for reacting with complexing acids to form optimum grease structures. The second being that the presence of unreacted solid calcium compounds (including calcium carbonate, calcium hydroxide or calcium oxide) interferes with the conversion process, resulting in inferior greases if the unreacted solids are not removed prior to conversion or before conversion is completed. However, Applicant has found that the addition of calcium carbonate as a separate ingredient (in addition to the amount of calcium carbonate contained in the overbased calcium sulfonate), calcium hydroxyapatite, or a combination thereof, either with or without added calcium hydroxide or calcium oxide, as ingredients for reacting with complexing acids produces a superior grease as described in the '574 and '768 applications.

There are a couple of prior art references that disclose the addition of crystalline calcium carbonate as a separate ingredient (in addition to the amount of calcium carbonate contained in the overbased calcium sulfonate), but those greases have poor thickener yield (as the prior art teaches) or require nano-sized particles of calcium carbonate. For example, U.S. Pat. No. 5,126,062 discloses the addition of 5-15% calcium carbonate as a separate ingredient in forming a complex grease, but also requires the addition of calcium hydroxide to react with complexing acids. The added calcium carbonate is not the sole added calcium containing base for reacting with complexing acids in the '062 patent. In fact, the added calcium carbonate is specifically not added as a basic reactant for reaction with complexing acids. Instead, added calcium hydroxide is required as the specific calcium-containing base for reaction with all the complexing acids. Additionally, the resulting NGLI No. 2 grease contains 36%-47.4% overbased calcium sulfonate, which is a substantial amount of this expensive ingredient. In another example, Chinese publication CN101993767, discloses the addition of nano-sized particles of calcium carbonate (sized between 5-300 nm) being added to the overbased calcium sulfonate, although the reference does not indicate that the nano-sized particles of calcium carbonate are added as a reactant, or the sole separately added calcium containing base, for reacting with complexing acids. The use of nano-sized particles would add to the thickening of the grease to keep it firm, much like the fine dispersion of crystalline calcium carbonate formed by converting the amorphous calcium carbonate contained within the overbased calcium sulfonate (which can be around 20 A to 5000 A or around 2 nm to 500 nm according to the '467 patent), but would also substantially increase the costs over larger sized particles of added calcium carbonate. This Chinese patent application greatly emphasizes the absolute necessity of the added calcium carbonate having a true nano particle size. As shown in the example greases according to the invention described in copending '574 application, superior greases may be formed by the addition of micron sized calcium carbonate without requiring the use of the very expensive nano-sized particles and when using added calcium carbonate as one of or the sole added calcium containing base for reacting with complexing acids.

There are also prior art references for using tricalcium phosphate as an additive in lubricating greases. For instance, U.S. Pat. Nos. 4,787,992; 4,830,767; 4,902,435; 4,904,399; 4,929,371 all teach using tricalcium phosphate as an additive for lubricating greases. However, it is believed that no prior art references teach the use of calcium hydroxyapatite, having the formula $Ca_5(PO_4)_3OH$ or a mathematically equivalent formula with a melting point of around 1100 C, as a calcium-containing base for reaction with acids to make lubricating greases, including calcium sulfonate-based greases. There are several prior art references assigned to Showa Shell Sekiyu in Japan, including U.S. Patent Application Publication No. 200910305920, that describe greases containing tricalcium phosphate, $Ca_3(PO_4)_2$, and reference a "hydroxyapatite" having the formula $[Ca_3(PO_4)_2]_3.Ca(OH)_2$ as a source of tricalcium phosphate. This reference to "hydroxyapatite" is disclosed as a mixture of tricalcium phosphate and calcium hydroxide, which is not the same as the calcium hydroxyapatite disclosed and claimed in the '768 application and herein having the formula $Ca_5(PO_4)_3OH$ or a mathematically equivalent formula with a melting point of around 1100 C. Despite the misleading nomenclature, calcium hydroxyapatite, tricalcium phosphate, and calcium hydroxide are each distinct chemical compounds with different chemical formulae, structures, and melting points. When mixed together, the two distinct crystalline compounds tricalcium phosphate ($Ca_3(PO_4)_2$) and calcium hydroxide ($Ca(OH)_2$) will not react with each other or otherwise produce the different crystalline compound calcium hydroxyapatite ($Ca_5(PO_4)_3OH$). The melting point of tricalcium phosphate (having the formula $Ca_3(PO_4)_2$) is 1670 C. Calcium hydroxide does not have a melting point, but instead loses a water molecule to form calcium oxide at 580 C. The calcium oxide thus formed has a melting point of 2580 C. Calcium hydroxyapatite (having the formula $Ca_5(PO_4)_3OH$ or a mathematically equivalent formula) has a melting point of around 1100 C. Therefore, regardless of how inaccurate the nomenclature may be, calcium hydroxyapatite is not the same chemical compound as tricalcium phosphate, and it is not a simple blend of tricalcium phosphate and calcium hydroxide.

Additionally, it is desirable to have a calcium sulfonate complex grease composition and method of manufacture that results in both improved thickener yield and dropping point. Many of the known prior art compositions require an amount of overbased calcium sulfonate of least 36% (by weight of the final grease product) to achieve a suitable grease in the NGLI No. 2 category with a demonstrated dropping point of at least 575 F. The overbased oil-soluble calcium sulfonate is one of the most expensive ingredients in making calcium sulfonate grease, therefore it is desirable to reduce the amount of this ingredient while still maintaining a desirable level of firmness in the final grease (thereby improving thickener yield). In order to achieve a substantial reduction in the amount of overbased calcium sulfonate used, many prior art references utilize a pressure reactor. It is desirable to have an overbased calcium sulfonate grease wherein the percentage of overbased oil-soluble calcium sulfonate is less than 36% and the dropping point is consistently 575 F or higher when the consistency is within an NLGI No. 2 grade (or the worked 60 stroke penetration of the grease is between 265 and 295), without requiring a pressure reactor. Higher dropping points are considered desirable since the dropping point is the first and most easily determined guide as to the high temperature utility limitations of a lubricating grease.

The addition of alkali metal hydroxides in simple calcium soap greases, such as anhydrous calcium-soap thickened greases, is also known. But it is not known to add an alkali metal hydroxide in a calcium sulfonate grease to provide improved thickener yield and high dropping point, because that addition would be considered unnecessary by one of ordinary skill in the art. The reason for adding an alkali metal hydroxide, such as sodium hydroxide, in simple calcium soap greases is that the usually used calcium hydroxide has poor water solubility and is a weaker base than the highly water soluble sodium hydroxide. Because of this, the small amount of sodium hydroxide dissolved in the added water is said to react quickly with the soap forming fatty acid (usually 12-hydroxystearic acid or a mixture of 12-hydroxystearic acid and a non-hydroxylated fatty acid such as oleic acid) to form the sodium soap. This quick reaction is thought to "get the ball rolling." However, the direct reaction of calcium-containing bases such as calcium hydroxide with fatty acids has never been a problem when making calcium sulfonate complex greases. The reaction occurs very easily, likely due to the high detergency/dispersancy of the large amount of calcium sulfonate present. As such, it is not known in the prior art to use an alkali metal hydroxide in a calcium sulfonate grease as a way to get the complexing acids to react with the calcium hydroxide.

It is also not known to combine various ingredients and methodologies in making a calcium sulfonate grease with improved thickener yield and high dropping, such as combining the addition of an alkali metal hydroxide with (1) the use of calcium hydroxyapatite, added crystalline calcium carbonate, or a combination thereof (without or without added calcium hydroxide or calcium oxide) as calcium containing bases (also referred to as basic calcium compounds) for reaction with complexing acids; (2) delayed addition of a non-aqueous converting agent; or (3) a combination of 1 and 2.

SUMMARY OF THE INVENTION

This invention relates to overbased calcium sulfonate greases and methods for manufacturing such greases to provide improvements in both thickener yield (requiring less overbased calcium sulfonate while maintaining acceptable penetration measurements) and expected high temperature utility as demonstrated by dropping point. According to one preferred embodiment of the invention, a complex calcium sulfonate grease composition comprises an alkali metal hydroxide. According to another preferred embodiment, a complex calcium sulfonate grease composition comprises an alkali metal hydroxide and calcium hydroxyapatite, added calcium carbonate, or both as added calcium containing bases (also referred to as basic calcium compounds) for reaction with complexing acids. According to yet another preferred embodiment, a complex calcium sulfonate grease composition comprises (1) less than 36% (by weight of the final grease) overbased calcium sulfonate; (2) calcium hydroxyapatite, added calcium carbonate, calcium hydroxide, calcium oxide, or any combination thereof; (3) one or more alkali metal hydroxides; (4) one or more converting agents; and (5) one or more complexing acids. According to yet another preferred embodiment, the final grease composition comprises around 0.005% to 0.5% alkali metal hydroxide.

According to a preferred method of producing a complex calcium sulfonate grease, an alkali metal hydroxide is added to other ingredients prior to or after conversion. Most preferably, the method comprises (a) mixing overbased calcium sulfonate and a base oil; (b) adding and mixing one or more calcium containing bases; (c) dissolving an alkali metal hydroxide in water and adding and mixing the solution with the other ingredients; (d) adding and mixing one or more converting agents, which may include the water from step c if added prior to conversion; (e) adding and mixing one or more complexing acids; and (f) heating some combination of these ingredients until conversion has occurred. Each of the ingredients in steps (b), (c), and (e) can be added prior to conversion, after conversion, or a portion added prior to and another portion added after conversion, and their order relative to each other is not critical for this embodiment of the method.

According to yet another preferred embodiment, a complex calcium sulfonate grease is produced by reacting and mixing certain compounds according to the steps outline above, except that a first portion of water is added as a converting agent prior to conversion and a second portion of water is added after conversion and the alkali metal hydroxide is dissolved in the first portion of water or the second portion of water or both. According to yet another preferred embodiment, water is added in at least two separate pre-conversion steps as a converting agent, with one or more temperature adjustment steps, addition of another ingredient(s) steps or a combination thereof between the first addition of water as a converting agent and the second addition of water as a converting agent and the alkali metal hydroxide is dissolved in the initial or first addition of water as a converting agent, or the second or subsequent addition of water as a converting agent, or both.

According to yet another preferred embodiment, a method for producing a complex calcium sulfonate grease comprises the steps outlined above, including preferred embodiment variations, wherein the converting agents comprise water and at least one non-aqueous converting agent and wherein there is one or more delay periods between the addition of water as a converting agent and the addition of at least a portion of a non-aqueous converting agent. Preferably, the one or more of the delay periods is a temperature adjustment delay period or a holding delay period or both, as further described below. As used herein, "non-aqueous converting agent" means any converting agent other than water and includes converting agents that may contain some water as a diluent or an impurity.

In any of the method embodiments described herein, all of one or more the complexing acids may be added prior to conversion or after conversion. Alternatively, a portion of one of more of the complexing acids may be added prior to conversion of the complex calcium sulfonate grease, with the remainder of the one or more complexing acids added after conversion. All of the one or more calcium containing bases may be added prior to conversion or after conversion. Alternatively, a portion of one or more of the calcium containing bases may be added prior to conversion, with the remainder added after conversion. Calcium hydroxyapatite, added calcium carbonate, added calcium hydroxide, added calcium oxide, or a combination thereof may be used as the calcium containing bases for reacting with the complexing acids. It is preferred that a large excess amount of calcium hydroxide relative to the total amount of complexing acids used (such as an amount of calcium hydroxide greater than 50% more than the stoichiometric amount needed for reaction with all complexing acids) not be added prior to conversion.

According to another preferred embodiment of the invention, improved thickener yield results are achieved using added alkali metal hydroxide, either alone or in combination with at least one delay period for at least a portion of a non-aqueous converting agent, even when the overbased calcium sulfonate is considered to be of "poor quality." Certain overbased oil-soluble calcium sulfonates marketed and sold for the manufacture of calcium sulfonate-based greases can provide products with unacceptably low dropping points when prior art calcium sulfonate technologies are used. Such overbased oil-soluble calcium sulfonates are referred to as "poor quality" overbased oil-soluble calcium sulfonates throughout this application. When all ingredients and methods are the same except for the commercially available batch of overbased calcium sulfonate used, overbased oil-soluble calcium sulfonates producing greases having higher dropping points (above 575 F) are considered to be "good" quality calcium sulfonates for purposes of this invention and those producing greases having lower dropping points are considered to be "poor" quality for purposes of this invention. Several examples of this are provided in the '768 application, which is incorporated by reference. Although comparative chemical analyses of good quality and poor quality overbased oil-soluble calcium sulfonates has been performed, it is believed that the precise reason for this low dropping point problem has not been proven. While most commercially available overbased calcium sulfonates are considered to be good quality, it is desirable to achieve both improved thickener yield and higher dropping points regardless of whether a good quality or a poor quality calcium sulfonate is used. It has been found that both improved thickener yield and higher dropping point may be achieved with either a good quality or a poor quality calcium sulfonate when an alkali metal hydroxide is used, particularly in combination with the delayed addition methods according to the invention. Indeed, the results of the examples using a poor quality overbased calcium sulfonate even demonstrate better thickener yields than those using a good quality overbased calcium sulfonate when using at least some of the preferred embodiments of this invention. According to another preferred embodiment, when at least one of the non-aqueous converting agents is a glycol (e.g. propylene glycol or hexylene glycol), all of the glycol is added after at least one delay period (none is added with the water) and a poor quality calcium sulfonate is used.

When produced in accordance with the parameters of the invention described herein, consistently high quality calcium sulfonate greases may be made with thickener yield and dropping point properties superior to those of prior art greases. The overbased calcium sulfonate complex greases made according to preferred embodiments of the invention have an NLGI No. 2 grade consistency (or better, i.e. harder) and a dropping point of 575° F. (or higher), with the percentage of overbased oil-soluble calcium sulfonate being between about 10% and 45% when made in an open vessel (without pressure). More preferably the amount of overbased oil-soluble calcium sulfonate in greases made according to preferred embodiments of the invention is at least around 10% but around 36% or less, more preferably around 30% or less, and most preferably around 22% or less when made in an open vessel (without pressure). These improved thickener yields are achievable with both good quality and poor quality overbased calcium sulfonates. Even greater thickener yield may be achieved with the ingredients and methods of the invention when the grease is made in a pressurized vessel. Most preferably a dropping point in excess of 650 F is achieved. The lower concentrations of the overbased oil-soluble calcium sulfonate achieved by the invention are desirable since the cost of the grease is reduced. Other properties such as mobility and pumpability, especially at lower temperatures, may also be favorably impacted by the improved thickener yield achieved according to the invention.

Without being bound by theory, it is believed that the addition of an alkali metal hydroxide results in a looping metathesis reaction that impacts the conversion process and the reaction with complexing acids to produce these unexpected thickener yield and dropping point results in complex calcium sulfonate greases. As previously discussed, alkali metal hydroxides are known to be added to simple calcium soap greases, but not to complex overbased calcium sulfonate greases. This is because the usually used calcium hydroxide in the simple calcium soap grease has poor water solubility and is a weaker base compared to the highly water soluble sodium hydroxide. Because of this, the small amount of sodium hydroxide dissolved in the added water is said to react quickly with the soap forming fatty acid (usually 12-hydroxystearic acid or a mixture of 12-hydroxystearic acid and a non-hydroxylated fatty acid such as oleic acid) to form the sodium soap. This quick reaction is thought to "get the ball rolling" in the manufacture of a simple calcium soap grease. However, if that is all that is happening, then once the small amount of sodium hydroxide reacts with a small amount of the fatty acid, it leaves the remaining reactants (calcium hydroxide and the remaining majority of the fatty acid) to react as if no sodium hydroxide had ever been added. The unreacted calcium hydroxide will still be present and will still have to react with the remaining unreacted fatty acid to form the calcium soap thickener.

The more likely explanation is that the small amount of sodium soap that is quickly formed further reacts with calcium hydroxide in a metathesis reaction where the sodium and calcium trade places. The sodium soap becomes a calcium soap, and the calcium hydroxide becomes sodium hydroxide. This reaction is driven by the high water solubility of sodium hydroxide and the much lower water solubility of the calcium soap relative to the sodium soap. This would then "regenerate" the small amount of sodium hydroxide so that it can again quickly react with more fatty acid. Then the metathesis reaction can occur again generating even more calcium soap. This looping reaction sequence continues until all the calcium hydroxide has reacted to form the calcium soap thickener. This reaction sequence loop is given below:

$$NaOH+RCOOH \rightarrow RCOO^{-}Na^{+} \quad \text{Reaction 1:}$$

$$2RCOO^{-}Na^{+}+Ca(OH)_2 \rightarrow (RCOO)_2Ca+2NaOH \quad \text{Reaction 2:}$$

NaOH Formed in Reaction 2 Becomes the Reactant for Reaction 1

Unlike simple calcium soap greases, the direct reaction of calcium-containing bases (such as calcium hydroxide) with fatty acids has never been a problem when making calcium sulfonate complex greases. The reaction occurs very easily, likely due to the high detergency/dispersancy of the large amount of calcium sulfonate present, which is why the addition of an alkali metal hydroxide has not been taught or suggested in the prior art calcium sulfonate grease technologies. Indeed, due to the high detergency/dispersancy of the large amount of calcium sulfonate present during the reaction of complexing acids with calcium-containing bases, one with ordinary skill in the art would not expect any significant benefit would be gained by adding a small amount of alkali metal hydroxide before such reactions. But it nonetheless appears the reaction of the alkali metal hydroxide has an unexpected beneficial impact on thickener yield in calcium sulfonate greases. When the addition of an alkali metal hydroxide is combined with the delayed addition of at least a portion of the non-aqueous converting agent methodology and the use of calcium hydroxyapatite and/or calcium carbonate as calcium containing bases for reacting with complexing acids, then the benefits are even greater. Preferred embodiments of the composition and method of the invention use the addition of an alkali metal hydroxide as an ingredient in a complex calcium sulfonate grease alone or in combination with (1) use of calcium hydroxyapatite and/or calcium carbonate as calcium containing bases for reacting with complexing acids and/or (2) one or more delay periods between the addition of water as a converting agent and the addition of at least a portion of a non-aqueous converting agent.

DESCRIPTION OF THE PREFERRED EMBODIMENTS

Complex Calcium Sulfonate Grease Compositions

According to one preferred embodiment of the invention, a complex calcium sulfonate grease composition comprises the following ingredients: (1) less than 45% (by weight of the final grease) overbased calcium sulfonate; (2) calcium hydroxyapatite, added calcium carbonate, calcium hydroxide, calcium oxide, or any combination thereof; and (3) an alkali metal hydroxide. More preferably, the complex calcium sulfonate grease also comprises (4) one or more converting agents; and (5) one or more complexing acids. According to another preferred embodiment, the one or more converting agents comprise water and at least one non-aqueous converting agent, such as propylene glycol or hexylene glycol. Optionally, the grease composition may also comprise a facilitating acid. Such facilitating acid aids in grease structure formation. Some or all of any particular ingredient, including converting agents and calcium containing bases, may not be in the final finished product due to evaporation, volatilization, or reaction with other ingredients during manufacture.

The highly overbased oil-soluble calcium sulfonate used according to these embodiments of the invention can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400 or higher. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation. The overbased calcium sulfonate contains around 28% to 40% dispersed amorphous calcium carbonate by weight of the overbased calcium sulfonate, which is converted to crystalline calcium carbonate during the process of making the calcium sulfonate grease. The overbased calcium sulfonate also contains around 0% to 8% residual calcium oxide or calcium hydroxide by weight of the overbased calcium sulfonate. Most commercial overbased calcium sulfonates will also contain around 40% base oil as a diluent, to keep the overbased calcium sulfonate from being so thick that it is difficult to handle and process. The amount of base oil in the overbased calcium sulfonate may make it unnecessary to add additional base oil (as a separate ingredient) prior to conversion to achieve an acceptable grease. The overbased calcium sulfonate used may be of a good quality or a poor quality as defined herein and in the '768 application.

The amount of the highly overbased oil-soluble calcium sulfonate in the final complex grease according to an embodiment of the invention can vary, but is generally between 10 and 45%. Preferably, the amount of the highly overbased oil-soluble calcium sulfonate in the final complex grease according to an embodiment of the invention is around 36% or less, more preferably around 30% or less, and most preferably around 22% or less when made in an open vessel (without pressure), with even smaller percentages achievable when made in pressurized vessels.

Any petroleum-based naphthenic or paraffinic mineral oils commonly used and well known in the grease making art may be used as the base oil according to the invention. Base oil is added as needed, since most commercial overbased calcium sulfonates will already contain about 40% base oil as a diluent so as to prevent the overbased sulfonate from being so thick that it cannot be easily handled, it may be unnecessary to add additional base oil depending on the desired consistency of the grease immediately after conversion as well as the desired consistency of the final grease. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. The total amount of base oil added (including that initially added and any that may be added later in the grease process to achieve the desired consistency) will typically be between 30% and 70%, preferably 45% and 70%, most preferably 50% and 70%, based on the final weight of the grease. Typically, the amount of base oil added as a separate ingredient will increase as the amount of overbased calcium sulfonate decreases. Combinations of different base oils as described above may also be used in the invention, as will be understood by those with ordinary skill in the art.

Water is added to the preferred embodiments of the invention as one converting agent. One or more other non-aqueous converting agents is also preferably added in these embodiments of the invention. The non-aqueous converting agents include any converting agent other than water, such as alcohols, ethers, glycols, glycol ethers, glycol polyethers, carboxylic acids, inorganic acids, organic nitrates, and any other compounds that contain either active or tautomeric hydrogen. Non-aqueous converting agents also include those agents that contain some water as a diluent or impurity. Although they may be used as non-aqueous converting agents, it is preferred not to use alcohols, such as methanol or isopropyl alcohol or other low molecular weight (i.e. more volatile) alcohols, because of environmental concerns and restrictions related to venting gases during the grease manufacturing process or hazardous waste disposal of scrubbed alcohols. The total amount of water added as a converting agent, based on the final weight of the grease, is between 1.5% and 10%, preferably between 2.0% and 5.0%, most preferably between 2.2% and 4.5%. Additional water may be added after conversion. Also, if the conversion takes place in an open vessel at a sufficiently high temperature so as to volatilize a significant portion of the water during conversion, additional water may be added to replace the water that was lost. The total amount of one or more non-aqueous converting agents added, based on the final weight of the grease, is between 0.1% and 5%, preferably 0.3% and 4%, most preferably 0.5% and 2.0%. Typically, the amount of non-aqueous converting agent used will decrease as the amount of overbased calcium sulfonate decreases. Depending on the converting agents used, some or all of them may be removed by volatilization during the manufacturing process. Especially preferred are the lower molecular weight glycols such as hexylene glycol and propylene glycol. It should be noted that some converting agents may also serve as complexing acids, to produce a calcium sulfonate complex grease according to one embodiment of the invention, discussed below. Such materials will simultaneously provide both functions of converting and complexing.

Although not required, a small amount of a facilitating acid may be added to the mixture prior to conversion according to another embodiment of the invention. Suitable facilitating acids, such as an alkyl benzene sulfonic acid, having an alkyl chain length typically between 8 to 16 carbons, may help to facilitate efficient grease structure formation. Most preferably, this alkyl benzene sulfonic acid comprises a mixture of alkyl chain lengths that are mostly about 12 carbons in length. Such benzene sulfonic acids are typically referred to as dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. When the alkyl benzene sulfonic acid is used in the present invention, it is added before conversion in an amount from about 0.50% to 5.0%, preferably 1.0% to 4.0%, most preferably 1.3% to 3.6%, based on the final weight of the grease. If the calcium sulfonate is made in situ using alkyl benzene sulfonic acid, the facilitating acid added according to this embodiment is in addition to that required to produce the calcium sulfonate.

One or more complexing acids, one or more calcium containing bases, and one or more alkali metal hydroxides are also added as ingredients in a preferred embodiment of a calcium sulfonate grease composition according to the invention. The calcium containing bases may include calcium hydroxyapatite, added calcium carbonate, added calcium hydroxide, added calcium oxide, or a combination of one or more of the foregoing. The calcium hydroxyapatite used as a calcium containing base for reacting with complexing acids according to this embodiment may be added pre-conversion, post-conversion, or a portion added pre- and a portion added post-conversion. Most preferably, the calcium hydroxyapatite is finely divided with a mean particle size of around 1 to 20 microns, preferably around 1 to 10 microns, most preferably around 1 to 5 microns. Furthermore, the calcium hydroxyapatite will be of sufficient purity so as to have abrasive contaminants such as silica and alumina at a level low enough to not significantly impact the anti-wear properties of the resulting grease. Ideally, for best results, the calcium hydroxyapatite should be either food grade or U.S. Pharmacopeia grade. The amount of calcium hydroxyapatite added will be between 1.0% and 20%, preferably 2% and 15%, most preferably 3% and 10%, based on the total weight of the grease, although more can be added, if desired, after conversion and all reaction with complexing acids is complete.

According to another embodiment of the invention, calcium hydroxyapatite may be added to the above ingredients in an amount that is insufficient to fully react with the complexing acids. In this embodiment, finely divided calcium carbonate as an oil-insoluble solid calcium-containing base may be added, preferably before conversion, in an amount sufficient to fully react with and neutralize the portion of any subsequently added complexing acids not neutralized by the calcium hydroxyapatite.

According to another embodiment, calcium hydroxyapatite may be added to the above ingredients in an amount that is insufficient to fully react with the complexing acids. In this embodiment, finely divided calcium hydroxide and/or calcium oxide as an oil-insoluble solid calcium-containing base may be added, preferably before conversion, in an amount sufficient to fully react with and neutralize the portion of any subsequently added complexing acids not neutralized by the co-added calcium hydroxyapatite. In this embodiment, the calcium hydroxide and/or calcium oxide preferably represents no more than 75% of the hydroxide equivalent basicity provided by the total of the added calcium hydroxyapatite, calcium hydroxide, and calcium oxide. In another embodiment, calcium carbonate may also be added with the calcium hydroxyapatite, calcium hydroxide and/or calcium oxide, with the calcium carbonate being added either before or after reacting with complexing acids. When the amounts of calcium hydroxyapatite, calcium hydroxide, and/or calcium oxide are not sufficient to neutralize the complexing acid or acids added, calcium carbonate is preferably added in an amount that is more than sufficient to neutralize any remaining complexing acid or acids.

The added calcium carbonate used as a calcium containing base, either alone or in combination with another calcium containing base or bases, according to these embodiments of the invention, is finely divided with a mean particle size of around 1 to 20 microns, preferably around 1 to 10 microns, most preferably around 1 to 5 microns. Furthermore, the added calcium carbonate is preferably crystalline calcium carbonate (most preferably calcite) of sufficient purity so as to have abrasive contaminants such as silica and alumina at a level low enough to not significantly impact the anti-wear properties of the resulting grease. Ideally, for best results, the calcium carbonate should be either food grade or U.S. Pharmacopeia grade. The amount of added calcium carbonate added is between 1.0% and 20%, preferably 2.0% and 15%, most preferably 3.0% and 10%, based on the final weight of the grease. These amounts are added as a separate ingredient in addition to the amount of dispersed calcium carbonate contained in the overbased calcium sulfonate. According to another preferred embodiment of the invention, the added calcium carbonate is added prior to conversion as the sole added calcium-containing base ingredient for reacting with complexing acids. Additional calcium carbonate may be added to either the simple or complex grease embodiments of the invention after conversion, and after all reaction with complexing acids is complete in the case of a complex grease. However, references to added calcium carbonate herein refer to the calcium carbonate that is added prior to conversion and as one of or the sole added calcium-containing base for reaction with complexing acids when making a complex grease according to the invention.

The added calcium hydroxide and/or added calcium oxide added pre-conversion or post-conversion according to another embodiment shall be finely divided with a mean particle size of around 1 to 20 microns, preferably around 1 to 10 microns, most preferably around 1 to 5 microns. Furthermore, the calcium hydroxide and calcium oxide will be of sufficient purity so as to have abrasive contaminants such as silica and alumina at a level low enough to not significantly impact the anti-wear properties of the resulting grease. Ideally, for best results, the calcium hydroxide and calcium oxide should be either food grade or U.S. Pharmacopeia grade. The total amount of calcium hydroxide and/or calcium oxide will be between 0.07% and 1.20%, preferably 0.15% and 1.00%, most preferably 0.18% and 0.80%, based on the total weight of the grease. These amounts are added as separate ingredients in addition to the amount of residual calcium hydroxide or calcium oxide contained in the overbased calcium sulfonate. Most preferably, an excess amount of calcium hydroxide relative to the total amount of complexing acids used is not added prior to conversion. According to yet another embodiment, it is not necessary to add any calcium hydroxide or calcium oxide for reacting with complexing acids and either added calcium carbonate or calcium hydroxyapatite may be used as the sole added calcium containing base for such reaction or may be used in combination for such reaction.

The added alkali metal hydroxides comprise sodium hydroxide, lithium hydroxide, potassium hydroxide, or a combination thereof. Most preferably sodium hydroxide is used as the alkali metal hydroxide. The total amount of alkali metal hydroxide added is preferably around 0.005% to 0.5%, more preferably around 0.01% to 0.4%, and most preferably around 0.02% to 0.20%, by weight of the final grease product. As with the calcium-containing bases, the alkali metal hydroxide reacts with complexing acids resulting in an alkali metal salt of a complexing acid present in the final grease product. The preferred amounts indicated here are amounts added as raw ingredients relative to the weight of the final grease product, even though no alkali metal hydroxide will be present in the final grease. According to one preferred embodiment, the alkali metal hydroxide is dissolved in the water prior to being added to other ingredients. The water used to dissolve the alkali metal hydroxide may be water used as a converting agent or water added post-conversion. It is most preferred to dissolve the alkali metal hydroxide in water prior to adding it to the other ingredients, but it may also be directly added to the other ingredients without first dissolving it in water.

Complexing acids used in these embodiments will comprise at least one and preferably two or more of the following: long chain carboxylic acids, short chain carboxylic acids, boric acid, and phosphoric acid. Acetic acid and other carboxylic acids may be used as a converting agent or complexing acid or both, depending on when it is added. Similarly, some complexing acids (such as the 12-hydroxystearic acid in the '514 and '467 patents) may be used as converting agents. The total amount of complexing acids added is preferably between 2.8% and 11% by weight of the final grease. The long chain carboxylic acids suitable for use in accordance with the invention comprise aliphatic carboxylic acids with at least 12 carbon atoms. Preferably, the long chain carboxylic acids comprise aliphatic carboxylic acids with at least 16 carbon atoms. Most preferably, the long chain carboxylic acid is 12-hydroxystearic acid. The amount of long chain carboxylic acid is between 0.5% and 5.0%, preferably 1.0% to 4.0%, most preferably 2.0% to 3.0%, based on the final weight of the grease.

Short chain carboxylic acids suitable for use in accordance with the invention comprise aliphatic carboxylic acids with no more than 8 carbon atoms, and preferably no more than 4 atoms. Most preferably, the short chain carboxylic acid is acetic acid. The amount of short chain carboxylic acids is between 0.05% and 2.0%, preferably 0.1% to 1.0%, most preferably 0.15% to 0.5%, based on the final weight of the grease. Any compound that can be expected to react with water or other components used in producing a grease in accordance with this invention with such reaction generating a long chain or short chain carboxylic acid are also suitable for use. For instance, using acetic anhydride would, by reaction with water present in the mixture, form the acetic acid to be used as a complexing acid. Likewise, using methyl 12-hydroxystearate would, by reaction with water present in the mixture, form the 12-hydroxystearic acid to be used as a complexing acid. Alternatively, additional water may be added to the mixture for reaction with such components to form the necessary complexing acid if sufficient water is not already present in the mixture.

If boric acid is used as a complexing acid according to this embodiment, an amount between 0.3% to about 4.0%, preferably 0.5% to 3.0%, and most preferably 0.6% and 2.0%, based on the final weight of the grease, is added. The boric acid may be added after first being dissolved or slurried in water, or it can be added without water. Preferably, the boric acid will be added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, borated carboxylic acids, borated sulfonic acids, borated epoxides, borated peroxides and the like may be used instead of boric acid. If phosphoric acid is used as a complexing acid, an amount between 0.4% to 4.0%, preferably 0.6% and 3.0%, most preferably 0.8% and 2.0%, based on the final weight of the grease, is added. The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

Other additives commonly recognized within the grease making art may also be added to either the simple grease embodiment or the complex grease embodiment of the invention. Such additives can include rust and corrosion inhibitors, metal deactivators, metal passivators, antioxidants, extreme pressure additives, antiwear additives, chelating agents, polymers, tackifiers, dyes, chemical markers, fragrance imparters, and evaporative solvents. The latter category can be particularly useful when making open gear lubricants and braided wire rope lubricants. The inclusion of any such additives is to be understood as still within the scope of the present invention. All percentages of ingredients are based on the final weight of the finished grease unless otherwise indicated, even though that amount of the ingredient may not be in the final grease product due to reaction or volatilization.

Methods of Making a Complex Calcium Sultanate Grease with Alkali Metal Hydroxide The calcium sulfonate grease compositions are preferably made according to the methods of the invention described herein. In one preferred embodiment, the method comprises: (1) mixing overbased calcium sulfonate and a base oil; (2) dissolving an alkali metal hydroxide in water and adding and mixing the solution with the other ingredients; (3) adding and mixing one or more calcium containing bases; (4) adding and mixing one or more converting agents, which may include the water from step c if added prior to conversion; (5) adding and mixing one or more complexing acids; and (6) heating some combination of these ingredients until conversion has occurred. In this preferred embodiment, there is no delay between the addition of water as a converting agent (if water is used as a converting agent) and the addition of any portion of any non-aqueous converting agents (if non-aqueous converting agents are used). In another preferred embodiment, the method comprises these same steps, except that the converting agents comprise water and at least one non-aqueous converting agent and there is one or more delay periods between the pre-conversion addition of the water and the addition of at least a portion of the one or more other non-aqueous converting agents. For ease of reference, the terms "alkali addition method" will be used to describe all preferred embodiments of methods according to the invention where an alkali metal hydroxide is added without any delayed addition of non-aqueous converting agents and the term "alkali/delayed addition method" will be used to described all preferred embodiments of methods according to the invention where both an alkali metal hydroxide is added and there is at least one delay period between the addition of water as a converting agent and the addition of at least part of the non-aqueous converting agent(s). The term "delayed addition method" will be used to refer to the delayed non-aqueous converting agent method of the '476 application without any alkali metal hydroxide addition.

In both the preferred alkali addition method and alkali/delayed addition method, each of the ingredients in steps (2), (3), and (5) can be added prior to conversion, after conversion, or a portion added prior and another portion added after conversion. Optionally, a facilitating acid may also be added and mixed with the ingredients, preferably prior to conversion. If a facilitating acid is used, it is also preferable that it be added to the mixture before the alkali metal hydroxide is added. Alternatively, the alkali metal hydroxide may be added to the other ingredients without first dissolving in water, but it is most preferred to pre-dissolve it in water. Most preferably, the specific ingredients and amounts used in the method are according to the preferred embodiments of the composition described herein.

In both the preferred alkali addition method and alkali/delayed addition method, the order of addition for the ingredients in steps (2), (3), and (5) relative to each other and to the ingredients in steps (1) and (4), and relative to the timing of heating the ingredients, is not critical. However, the addition of some ingredients before or after other ingredients and/or before or after heating is preferred as described below. Additionally, the order of addition of converting agents is critical in the alkali/delayed addition method as described further below.

According to yet another preferred embodiment of both the alkali addition method and alkali/delayed addition method, a complex calcium sulfonate grease is produced by reacting and mixing certain compounds according to the steps outlined above, except that a first portion of water is added as a converting agent prior to conversion and a second portion of water is added after conversion and the alkali metal hydroxide is dissolved in the first portion of water or the second portion of water or both. According to yet another preferred embodiment of both the alkali addition method and alkali/delayed addition method, water is added in at least two separate pre-conversion steps as a converting agent, with one or more temperature adjustment steps, addition of another ingredient(s) steps or a combination thereof between the first addition of water as a converting agent and the second addition of water as a converting agent and the alkali metal hydroxide is dissolved in the initial or first addition of water as a converting agent, or the second or subsequent addition of water as a converting agent, or both.

According to yet another preferred embodiment of both the alkali addition method and alkali/delayed addition method, at least part of the complexing acids are added prior to heating. According to another preferred embodiment, all of the complexing acid(s) are added prior to heating. According to yet another preferred embodiment of both the alkali addition method and alkali/delayed addition method, when added calcium carbonate is used as the added calcium containing base for reacting with complexing acids, it added before any complexing acid(s). According to yet another preferred embodiment of both the alkali addition method and alkali/delayed addition method, calcium hydroxyapatite, added calcium hydroxide and added calcium carbonate are all used as calcium containing bases for reacting with complexing acids. In this embodiment, it is most preferred to add the calcium hydroxyapatite and at least a portion of the calcium hydroxide prior to adding any complexing acids and add the calcium carbonate after at least part of the complexing acids are added, if complexing acids are added prior to conversion. According to another preferred embodiment of both the alkali addition method and alkali/delayed addition method, the water with dissolved alkali metal hydroxide is added after the calcium containing base(s) are added and/or after a portion of the pre-conversion complexing acid(s) are added. According to another preferred embodiment, the water with dissolved alkali metal hydroxide (or alkali metal hydroxide added separately) are added before adding a least a portion of one or more complexing acids.

According to several other embodiments of both the alkali addition method and alkali/delayed addition method, the steps are the same as the above embodiments except that step (3) (addition of calcium containing base(s)) involves one of the following: (a) admixing finely divided calcium hydroxyapatite prior to conversion as the only calcium containing base added; (b) admixing finely divided calcium hydroxyapatite and calcium carbonate in an amount sufficient to fully react with and neutralize subsequently added complexing acids, according to one embodiment; (c) admixing finely divided calcium hydroxyapatite and calcium hydroxide and/or calcium oxide in an amount sufficient to fully react with and neutralize subsequently added complexing acids, with the calcium hydroxide and/or calcium oxide preferably being present in an amount not more than 75% of the hydroxide equivalent basicity provided by the total of the added calcium hydroxide and/or calcium oxide and the calcium hydroxyapatite, according to another embodiment of the invention; (d) admixing added calcium carbonate after conversion, according to another embodiment of the invention; (e) admixing calcium hydroxyapatite after conversion and in an amount sufficient to completely react with and neutralize any complexing acids added post-conversion, according to yet another embodiment of the invention; (f) admixing finely divided calcium carbonate as an oil-insoluble solid calcium-containing base prior to conversion and admixing finely divided calcium hydroxyapatite and calcium hydroxide and/or calcium oxide in an amount insufficient to fully react with and neutralize subsequently added complexing acids, with the calcium hydroxide and/or calcium oxide preferably being present in an amount not more than 75% of the hydroxide equivalent basicity provided by the total of the added calcium hydroxide and/or calcium oxide and the calcium hydroxyapatite, with the previously added calcium carbonate being added in an amount sufficient to fully react with and neutralize the portion of any subsequently added complexing acids not neutralized by the calcium hydroxyapatite and calcium hydroxide and/or calcium oxide.

For the alkali/delayed addition method, there is at least one delay period between the pre-conversion addition of the water and the pre-conversion addition of at least a portion of the one or more other non-aqueous converting agents. A first delay period begins after the first addition of water as a converting agent. If additional water is added pre-conversion to make up for evaporation losses during the manufacturing process, those additions are not used in re-starting or determining delay periods, and only the first addition of water is used as the starting point in determining delay periods. Most preferably, one or more of the delay periods (time between pre-conversion addition of water and addition of at least a portion of a non-aqueous converting agent) is a temperature adjustment delay period or a holding delay period or both. The delay periods may involve multiple temperature adjustment delay periods and multiple holding delay periods.

For example, a first temperature adjustment delay period is the period of time after water is added that it takes to change the temperature of the mixture (typically by heating) to a desired temperature or range of temperatures (the first temperature). A first holding delay period is the amount of time the mixture is held at the first temperature. A second temperature adjustment delay period is the period of time after the first holding delay that it takes to heat or cool the mixture to another temperature or temperature range (the second temperature). A second temperature adjustment delay period may also be the amount of time after a first temperature adjustment delay period to heat or cool the mixture to another temperature or range of temperatures (the second temperature) when another ingredient (such as a complexing acid) is added after reaching the first temperature, but there is no delay period between reaching that temperature and continuing to heat or cool to the second temperature. A second holding delay period is the amount of time the mixture is held at the second temperature. Additional temperature adjustment delay periods and holding delay periods (i.e. a third temperature adjustment delay period) follow the same pattern. The first temperature may be ambient temperature or an elevated temperature. Any subsequent temperature may be higher or lower than the previous temperature. The final pre-conversion temperature will be between about 190° F. and 220° F. or up to 230° F., as the temperature at which conversion in an open kettle typically occurs. Final pre-conversion temperatures can be below 190 F, however such process conditions will usually result in significantly longer conversion times, and thickener yields may also be diminished. The final pre-conversion temperature and temperature range at which conversion occurs may be different in a closed vessel. Any combination of temperature adjustment delay periods and/or holding delay periods may be used. Most preferably, the mixture of pre-conversion ingredients is heated to a temperature or temperature range during at least one of the delay periods or during each delay period.

Generally, a holding delay period will be followed or preceded by a temperature adjustment delay period and vice versa, but there may be two holding delay periods back to back or two temperature adjustment periods back to back. For example, the mixture may be held at ambient temperature for 30 minutes prior to adding one non-aqueous converting agent (a first holding delay period) and may continue to be held at ambient temperature for another hour prior to adding the same or a different non-aqueous converting agent (a second holding delay period). Additionally, the mixture may be heated or cooled to a first temperature after which a non-aqueous converting agent is added (a first temperature adjustment period) and then the mixture is heated or cooled to a second temperature after which the same or a different non-aqueous converting agent is added (a second temperature adjustment period, without any interim holding period). Additionally, a portion of a non-aqueous converting agent need not be added after every delay period, but may skip delay periods prior to addition or between additions. For example, the mixture may be heated to a temperature (first temperature adjustment delay period) and then held at that temperature for a period of time (a first holding delay period) before adding any non-aqueous converting agent.

If a non-aqueous converting agent or portion thereof is added immediately after reaching a temperature or range of temperatures, then there is no holding delay period for that particular temperature and that portion of the non-aqueous converting agent; but if another portion is added after holding at that temperature or range of temperatures for a period of time then there is a holding time delay for that temperature and that portion of the non-aqueous converting agent. A portion of one or more non-aqueous converting agents may be added after any temperature adjustment delay period or holding delay period and another portion of the same or a different non-aqueous converting agent may be added after another temperature adjustment delay period or holding delay period. Generally, the duration of each temperature adjustment delay period will be about 30 minutes to 24 hours, or more typically about 30 minutes to 5 hours. However, the duration of any temperature adjustment delay period will vary depending on the size of the grease batch, the equipment used to mix and heat the batch, and the temperature differential between the starting temperature and final temperature, as will be understood by those of ordinary skill in the art.

According to various preferred embodiments of the alkali/delayed addition method, different variations on the delay period may also be used. For example, each of the following are separate preferred embodiments: (a) at least a portion of a non-aqueous converting agent is added with the first addition of water (at substantially the same time) and another portion of the same non-aqueous converting agent and/or a different non-aqueous converting agent is added after at least one delay period; (b) no amount of non-aqueous converting agent is added at substantially the same time as the water and there is at least one delay period prior to the addition of any non-aqueous converting agent: (c) at least a portion of a non-aqueous converting agent is added after the mixture is heated to the final pre-conversion temperature range between about 190 F and 230 F (as the temperature range at which conversion occurs in an open vessel, or heated to an appropriate temperature range at which conversion occurs if made in a closed vessel); (d) when at least one of the non-aqueous converting agents is a glycol (e.g. propylene glycol or hexylene glycol), a portion of the glycol is added at substantially the same time as the water and another portion of glycol and all of any other non-aqueous converting agents are added after at least one delay period; (e) when acetic acid is added pre-conversion, it is added at substantially the same time as the water, and another (different) non-aqueous converting agent is added after a delay period; (f) at least a portion of one or more non-aqueous converting agents is added at the end of a final of the one or more delay periods and another portion of the same and/or a different non-aqueous converting agent is added after one or more prior delay periods; or (g) all of the one or more non-aqueous converting agents are added at the end of a final of the one or more delay periods.

According to one preferred embodiment of the alkali/delayed addition method, all or a portion of the non-aqueous converting agents are added in a batch manner (all at once, en masse, as opposed to a continuous addition over the course of a delay period, described below) after a delay period. It is noted, however, that in large or commercial scale operations, it will take some time to complete the batch addition of such non-aqueous converting agents to the grease batch because of the volume of materials involved. In batch addition, the amount of time it takes to add the non-aqueous converting agent to the grease mixture is not considered a delay period. In that case, any delay prior to the addition of that non-aqueous converting agent or portion thereof ends at the start time of the batch addition of the non-aqueous converting agent. According to another preferred embodiment, at least one or a portion of one non-aqueous converting agent is added in a continuous manner during the course of a delay period (either a temperature adjustment delay period or a holding delay period). Such continuous addition may be by slowly adding the non-aqueous converting agent at a substantially steady flow rate or by repeated, discrete, incremental additions during a temperature adjustment delay period, a holding delay period, or both. In that case, the time it takes to fully add the non-aqueous converting agent is included in the delay period, which ends when the addition of non-aqueous converting agent is complete. According to yet another preferred embodiment of the alkali/delayed addition method, at least a portion of one non-aqueous converting agent is added in a batch manner after a delay period and at least another portion of the same or a different non-aqueous converting agent is added in a continuous manner during a delay period. According to another preferred embodiment of the alkali/delayed addition method, alcohols are not used as non-aqueous converting agents.

Although a delay period within the scope of this invention may involve a holding delay period that does not involve heating (e.g. where the mixture was held at ambient temperature for a first holding delay period prior to heating), a short period of time of less than 15 minutes between the addition of water as a converting agent and the addition of all of the non-aqueous converting agent(s) without any heating during that time period is not a "delay" or "delay period" as used herein. A delay for the addition of any or all of the non-aqueous converting agent(s) without heating during the delay period, for purposes of this invention, should be at least about 20 minutes and more preferably at least about 30 minutes. An interval of less than 20 minutes between the addition of water and a portion of a non-aqueous converting agent, without heating during the 20 minutes, but with a subsequent longer holding delay period or subsequent heating prior to the addition of another portion of the same, or a portion or all of a different, non-aqueous converting agent(s) does involve a "delay period" within the scope of the invention. In that case, the initial short interval is not a "delay period," but the subsequent longer holding delay or temperature adjustment delay prior to addition of a non-aqueous converting agent is a holding delay period or temperature adjustment delay period for purposes of this invention. Additionally, all or some portion of one or more of the non-aqueous converting agents may be slowly added during one or more temperature adjustment delay periods or holding delay periods or both. Such slow addition may include a substantially continuous addition of the non-aqueous converting agent during the delay period(s) or repeated, incremental additions during the delay period(s).

Additionally, when acetic acid or 12-hydroxystearic acid are added pre-conversion, these acids acid will have a dual role as both converting agent and complexing acid. When these acids are added along with another more active non-aqueous converting agent (such as a glycol), the acid may be considered to act primarily in the role of complexing acid, with the more active agent taking on the primary role of converting agent. As such, when acetic acid or 12-hydroxystearic acid is added pre-conversion along with a more active converting agent, any elapsed time between the addition of water and any portion of the acetic acid or 12-hydroxystearic acid is not considered a delay as that term is used herein. In that case, only temperature adjustment delay periods or holding delay periods between the pre-conversion addition of water and the pre-conversion addition of any portion of the other non-aqueous converting agent are considered delays for purposes of this invention. If acetic acid or 12-hydroxystearic acid or a combination thereof is/are the only non-aqueous converting agent(s) used, then a temperature adjustment delay period or holding delay period between the pre-conversion addition of water and the pre-conversion addition of any portion of the acetic acid or 12-hydroxystearic acid would be a delay for purposes of this invention.

One preferred embodiment of the alkali/delayed addition method according to the invention comprises steps of: (1) admixing in a suitable grease manufacturing vessel the following ingredients: water as a converting agent, a highly overbased oil-soluble calcium sulfonate containing dispersed amorphous calcium carbonate, optionally an appropriate amount of a suitable base oil (if needed), one or more alkali metal hydroxides, and optionally at least a portion of one or more non-aqueous converting agents to form a first mixture; (2) mixing or stirring the first mixture while maintaining it at a temperature or within a range of temperatures and/or adjusting the temperature of the first mixture to heat or cool it to another temperature(s) or range of temperatures during one or more delay periods; (3) optionally admixing at least a portion of one or more non-aqueous converting agents with the first mixture after or during one or more delay periods to form a second mixture; (4) heating the first mixture (or second mixture if non-aqueous converting agents are added in step 3) to a conversion temperature (preferably in the range of 190 F to 230 F, higher than the typical range of 190 F to 220 F, for an open vessel) to form a third mixture during the final of the one or more delay periods; (5) after or during step 4, admixing all or any remaining portion (if any) of the one or more non-aqueous converting agents; and (6) converting the third mixture by continuing to mix while maintaining the temperature in the conversion temperature range (preferably 190 F to 230 F, for an open vessel) until conversion of the amorphous calcium carbonate contained in the overbased calcium sulfonate to very finely divided crystalline calcium carbonate is complete; (7) admixing one or more calcium containing bases; (8) optionally admixing a facilitating acid; and (9) admixing one or more of suitable complexing acids. This process results in a preferred complex calcium sulfonate grease. Step (7) may be carried out prior to conversion or after conversion, or some portion or all of one or more calcium containing bases may be added prior to conversion and some portion or all of one or more calcium containing bases may be added after conversion. Step (8) may be carried out at any time prior to conversion. Step (9) may be carried out prior to conversion or after conversion, or some portion or all of one or more of the complexing acids may be added prior to conversion and some portion or all of one or more of the complexing acids added after conversion. Most preferably, this alkali/delayed addition method is carried out in an open vessel, but may also be carried out in a pressurized vessel. Most preferably, the one or more alkali metal hydroxides are dissolved in the water to be used as a converting agent prior to adding them in step (1). Alternatively, the alkali metal hydroxide may be omitted from step (1) and may be dissolved in water and the solution added at a later step prior to conversion or after conversion.

For any of the preferred embodiments of the alkali/delayed addition method described herein, any portion of a non-aqueous converting agent added in steps 1, 3, and/or 5 may be the same non-aqueous converting agent as that added in another step or steps or different from any non-aqueous converting agent added in another step or steps. Provided that at least a portion of at least one non-aqueous converting agent is added after a delay period (in step 3 or step 5), another portion of the same and/or at least a portion of a different non-aqueous converting agent or agents may be added in any combination of steps 1, 3, and/or 5. According to another preferred embodiment of the alkali/delayed addition method, all of the one or more of the non-aqueous converting agents are admixed after the final delay period in step 5, with none being added during steps 1 or 3. According to another preferred embodiment of the alkali/delayed addition method, at least a portion of one or more non-aqueous converting agents is added with the first mixture in step 1 prior to any delay and at least a portion of the same or a different non-aqueous converting agent is added in step 3 and/or in step 5. According to another preferred embodiment of the alkali/delayed addition method, no non-aqueous converting agents are added with the first mixture and at least a portion of one or more non-aqueous converting agents is added is added in step 3 and in step 5. According to another preferred embodiment of the alkali/delayed addition method, at least a portion of one or more non-aqueous converting agents is added after or during one delay period in step 3 and at least a portion of the same or a different non-aqueous converting agent is added after or during another delay period (a second delay period in step 3 and/or a final delay period in step 5). According to another preferred embodiment of the alkali/delayed addition method, at least a portion of one or more non-aqueous converting agents is added after one or more delays in step 3, but no non-aqueous converting agents are added after the final delay period in step 5.

The order of steps (2)-(6) for making a complex grease are important aspects of the invention with respect to embodiments including the alkali/delayed addition method. Certain other aspects of the process are not critical to obtaining a preferred calcium sulfonate grease compositions according to the invention. For instance, the order that the calcium containing bases are added relative to each other is not critical. Also, the temperature at which the water as a converting agent and calcium containing bases are added is not critical in order to obtain an acceptable grease, but it is preferred that they be added before the temperature reaches 190 F to 200 F (or other temperature range at which conversion occurs when made in a closed vessel). When more than one complexing acid is used, the order in which they are added either before or after conversion is also not generally critical.

Another preferred embodiment of the alkali/delayed addition method comprises: mixing water, one or more alkali metal hydroxides, less than 45% overbased calcium sulfonate containing dispersed amorphous calcium carbonate, and optionally base oil to form a first mixture; adding at least a portion of one or more non-aqueous converting agents to the first mixture after or during one or more delay periods to form a pre-conversion mixture; converting the pre-conversion mixture to a converted mixture by heating until conversion of the amorphous calcium carbonate contained in the overbased calcium sulfonate to crystalline calcium carbonate has occurred, with at least one of the delay periods being a holding delay period where the first mixture or pre-conversion mixture is maintained at a temperature or within a range of temperatures for a period of time. In an alternate embodiment, the one or more alkali metal hydroxides are added after conversion instead of pre-conversion or a portion is added pre-conversion and a portion is added post-conversion. The pre-conversion and post-conversion additions may be of the same or a different alkali metal hydroxide.

Another preferred embodiment of the alkali/delayed addition method comprises: mixing water, one or more alkali metal hydroxides, less than 36% overbased calcium sulfonate containing dispersed amorphous calcium carbonate, and optionally base oil to form a first mixture; adding at least a portion of one or more non-aqueous converting agents to the first mixture after or during one or more delay periods to form a pre-conversion mixture; converting the pre-conversion mixture to a converted mixture by heating until conversion of the amorphous calcium carbonate contained in the overbased calcium sulfonate to crystalline calcium carbonate has occurred. In an alternate embodiment, the one or more alkali metal hydroxides are added after conversion instead of pre-conversion or a portion is added pre-conversion and a portion is added post-conversion. The pre-conversion and post-conversion additions may be of the same or a different alkali metal hydroxide.

Another preferred embodiment of the alkali/delayed addition method comprises the steps of: admixing in a suitable grease manufacturing vessel a highly overbased oil-soluble calcium sulfonate containing dispersed amorphous calcium carbonate and an amount of suitable base oil (if needed) and begin mixing. Then one or more facilitating acids are added and mixed, preferably for about 20-30 minutes. Then all of the calcium hydroxyapatite is added, followed by a portion of the calcium hydroxide, and then all of the calcium carbonate, which is mixed for another 20-30 minutes. Next a portion of the acetic acid and a portion of the 12-hydroxystearic acid are added and mixed for another 20-30 minutes (it is noted that these ingredients may be converting agents, but since they are added before the water there is no delay period with respect to them). Then water used as a converting agent, with a small amount of an alkali metal hydroxide having been dissolved in the water, is added and mixed while heating to a temperature between 190° F. and 230° F. (a first temperature adjustment delay period and the final delay period). Then all of the hexylene glycol is added as a non-aqueous converting agent. The mixture is converted by continuing to mix while maintaining the temperature in the conversion temperature range (preferably 190 F to 230 F, for an open vessel) until conversion of the amorphous calcium carbonate contained in the overbased calcium sulfonate to very finely divided crystalline calcium carbonate is complete. After conversion, the remaining calcium hydroxide is added and mixed for about 20-30 minutes. Then the remaining acetic acid and remaining 12-hydroxystearic acid are added and mixed for around 30 minutes. Next boric acid dispersed in water is added followed by the slow, gradual addition of phosphoric acid. The mixture is then heated to remove water and volatiles, cooled, more base oil is added as needed, and the grease is milled as described below. Additional additives may be added during the final heating or cooling steps. According to another preferred embodiment of the alkali/delayed addition method, the steps and ingredients are the same as outlined above except that after adding the water as a converting agent and before adding all of the hexylene glycol as a non-aqueous converting agent, the mixture is heated to around 160° F. (a first temperature adjustment delay period) and held at that temperature for around 30 minutes (a first holding delay period) before continuing to heat to between 190° F. and 230° F. (a second temperature adjustment delay period and the final delay period).

The preferred embodiments of both the alkali addition method and the alkali/delayed addition method may occur in either an open or closed kettle as is commonly used for grease manufacturing. The conversion process can be achieved at normal atmospheric pressure or under pressure in a closed kettle. Manufacturing in open kettles (vessels not under pressure) is preferred since such grease manufacturing equipment is commonly available. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art. Manufacturing in pressurized kettles may also be used and may result in even greater improvement in thickener yield, but the pressurized processes may be more complicated and difficult to control. Additionally, manufacturing calcium sulfonate greases in pressurized kettles may result in productivity issues. The use of pressurized reactions can be important for certain types of greases (such as polyurea greases) and most grease plants will only have a limited number of pressurized kettles available. Using a pressurized kettle to make calcium sulfonate greases, where pressurized reactions are not as important, may limit a plant's ability to make other greases where those reactions are important. These issues are avoided with open vessels.

Most preferably, both the alkali addition method and the alkali/delayed addition method of making a complex calcium sulfonate grease also includes the steps of: (a) mixing additional base oil and complexing acids, as needed after conversion; (b) mixing and heating to a temperature sufficiently high to insure removal of water and any volatile reaction byproducts and optimize final product quality; (c)

cooling the grease while adding additional base oil as needed; (d) adding remaining desired additives as are well known in the art; and, if desired, (e) milling the final grease as required to obtain a final smooth homogenous product. Although the order and timing of these final steps is not critical, it is preferred that water be removed quickly after conversion. Generally, the grease is heated (preferably under open conditions, not under pressure, although pressure may be used) to between 250 F and 300 F, preferably 300 F to 380 F, most preferably 380 F to 400 F, to remove the water that was initially added as a converting agent, as well as any water formed by chemical reactions during the formation of the grease. Having water in the grease batch for prolonged periods of time during manufacture may result in degradation of thickener yield, dropping point, or both, and such adverse effects may be avoided by removing the water quickly. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed. If during manufacture it can be determined that all water has been removed before the temperature of the grease reaches the preferred 300 F value, then any polymer additives may preferably be added at any time thereafter.

Examples 1-18 in U.S. Pat. No. 9,273,265 and 1-29 in the 768 application are incorporated herein by reference. The overbased calcium sulfonate grease compositions and methods for making such compositions according to the invention are further described and explained in relation to the following examples:

Example 1A (Baseline Example—No Alkali Addition Method, No Alkali/Delayed Addition Method)

A calcium sulfonate complex grease according to the composition of the '768 application was made as follows: 264.61 grams of 400 TBN overbased oil-soluble calcium sulfonate were added to an open mixing vessel followed by 327.55 grams of a solvent neutral group 1 paraffinic base oil having a viscosity of about 600 SUS at 100 F, and 11.70 grams of PAO having a viscosity of 4 cSt at 100 C. The 400 TBN overbased oil-soluble calcium sulfonate was a poor quality calcium sulfonate similar to the one previously described and used in Examples 10 and 11 of the '768 application. Mixing without heat began using a planetary mixing paddle. Then 23.94 grams of a primarily C12 alkylbenzene sulfonic acid were added. After mixing for 20 minutes, 50.65 grams of calcium hydroxyapatite with a mean particle size of around 1 to 5 microns, and 3.63 grams of food grade purity calcium hydroxide having a mean particle size of around 1 to 5 microns were added and allowed to mix in for 30 minutes. The amount of calcium hydroxide added as a separate ingredient is in addition to the amount of residual calcium hydroxide contained within the overbased calcium sulfonate. Then 0.88 grams of glacial acetic acid and 10.53 grams of 12-hydroxystearic acid were added and allowed to mix in for 10 minutes. Then 55.03 grams of finely divided calcium carbonate with a mean particle size around 1 to 5 microns were added and allowed to mix in for 5 minutes. The amount of calcium carbonate added as a separate ingredient is in addition to the amount of dispersed calcium carbonate contained within the overbased calcium sulfonate. Then 13.20 grams of hexylene glycol (a non-aqueous converting agent) and 38.22 grams water were added at the substantially the same time (no delay period). The mixture was heated until the temperature reached 190 F. The temperature was held between 190 F and 200 F for 45 minutes until Fourier Transform Infrared (FTIR) spectroscopy indicated that the conversion of the amorphous calcium carbonate to crystalline calcium carbonate (calcite) had occurred.

Due to the heaviness of the converted grease, another 56.07 grams of the same paraffinic base oil were added. Then 7.36 grams of the same calcium hydroxide were added and allowed to mix in for 10 minutes. Then 1.52 grams of glacial acetic acid were added followed by 27.30 grams of 12-hydroxystearic acid. As these acids reacted and further thickened the grease, 111.07 grams of the paraffinic base oil were added. Then 9.28 grams of boric acid was mixed in 50 grams of hot water and the mixture was added to the grease. Another 54.47 grams of paraffinic base oil were added followed by 17.92 grams of a 75% solution of phosphoric acid in water. The mixture was then heated with an electric heating mantle while continuing to stir. When the grease reached 300 F, 22.22 grams of a styrene-ethylene-propylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.01 grams of food grade anhydrous calcium sulfate having a mean particle size of around 1 to 5 microns were added. When the temperature of the grease cooled to 200 F, 4.43 grams of a polyisobutylene polymer were added. Mixing continued until the grease reached a temperature of 170 F. The grease was then removed from the mixer and given three passes through a three-roll mill to achieve a final smooth homogenous texture. The grease had a worked 60 stroke penetration of 287. The percent overbased oil-soluble calcium sulfonate in the final grease was 23.9%. The dropping point was >650 F. In this example, calcium hydroxyapatite and calcium carbonate were added before conversion, according to an embodiment of the '768 application. Also, 33% of the total amount of calcium hydroxide was added before conversion followed by 35% of the total amount glacial acetic acid and 28% of the total amount of 12-hydroxystearic acid. The remaining amounts of calcium hydroxide, glacial acetic acid, 12-hydroxystearic acid were added after conversion.

Example 1B (Delayed Addition Method of '476 Application, No Alkali Addition)

Another calcium complex grease using the same equipment, raw materials, amounts, and manufacturing process as the Example 1A grease was made, except that there was a delay in adding the non-aqueous converting agent (hexylene glycol). The other initial ingredients (including water) were mixed and heated to a temperature of about 190° F. (a first temperature adjustment delay period) and the hexylene glycol was added immediately upon reaching 190° F. (no holding delay period). When the hexylene glycol was added, conversion rapidly occurred. The grease was held at 190 F-200 F for an additional 45 minutes. Then the remaining process was the same as the previous Example 1 grease. The final grease had a worked 60 stroke penetration of 290. The percent overbased oil-soluble calcium sulfonate in the final grease was 21.4%. The dropping point was >650 F. As can be seen, the grease of this example had an improved thickener yield compared to the grease of the previous Example 1 as evidenced by the lower final percentage of overbased calcium sulfonate as compared to the worked penetration.

Example 2 (Embodiment of Alkali/Delayed Addition Method)

Another calcium sulfonate complex grease was made similar to the Example 1B grease, including delayed addition of the non-aqueous converting agent, except that an alkali metal hydroxide was also added to the water. The grease was made as follows: 240.35 grams of 400 TBN overbased oil-soluble calcium sulfonate were added to an open mixing vessel followed by 345.33 grams of a solvent neutral group 1 paraffinic base oil having a viscosity of about 600 SUS at 100 F, and 10.79 grams of PAO having a viscosity of 4 cSt at 100 C. The 400 TBN overbased oil-soluble calcium sulfonate was a poor quality calcium sulfonate similar to the one previously described and used in Examples 10 and 11 of U.S. patent application Ser. No. 13/664,768. Mixing without heat began using a planetary mixing paddle. Then 21.81 grams of a primarily C12 alkylbenzene sulfonic acid were added. After mixing for 20 minutes, 46.14 grams of calcium hydroxyapatite with a mean particle size below 5 microns and 3.34 grams of food grade purity calcium hydroxide having a mean particle size below 5 microns were added and allowed to mix in for 30 minutes Then 50.20 grams of finely divided calcium carbonate with a mean particle size below 5 microns were added and allowed to mix in for 5 minutes. Then 35 grams water into which 0.41 grams powdered sodium hydroxide had been dissolved were added.

The mixture was heated to about 180 F. Then 0.76 grams of glacial acetic acid (primarily as a complexing acid, since glycol is added later as a non-aqueous converting agent) and 9.63 grams of 12-hydroxystearic acid were added. It is noted that 12-hydroxystearic acid will quickly melt, dissolve, and react at a temperature of around 180 F at which it was added. Shortly after adding the two complexing acids the mixture began to develop an appearance of whipped cream. This appearance does not typically occur when the added water does not contain a small amount of alkali metal hydroxide, and it is likely somehow related to the more rapid formation of the calcium salts of the complexing acids. Without being bound by theory, one possible explanation of the whipped cream appearance is that as the sodium fatty acid salt is first formed, a small steady state concentration is maintained until all the calcium fatty acid salts have formed. Sodium fatty acid salts are well-known to be surface active with water and can cause foaming, which may result in the whipped cream appearance.

The mixture was stirred while continuing to heat to a temperature of 190 F to 200 F (a first temperature adjustment delay period). When the 190 F to 200 F temperature range had been reached, the whipped cream appearance subsided. Then, 12.46 grams of hexylene glycol were added as the non-aqueous converting agent. After an hour and 10 minutes visible conversion had not yet occurred. An FTIR also indicated that most of the initially added water had been lost due to evaporation. An additional 35 ml of water and another 12.47 grams of hexylene glycol were added. After another one hour and 20 minutes, visible conversion occurred.

The grease continued to become thicker and thicker with time. Two nearly equal portions of the same paraffinic base oil totaling 100.93 grams were added to keep the grease from becoming too heavy to effectively stir. Once additional thickening seemed to stop, another 30 ml of water was added due to evaporative loss. Fourier Transform Infrared (FTIR) spectroscopy indicated that the conversion of the amorphous calcium carbonate to crystalline calcium carbonate (calcite) had occurred. Then 6.80 grams of the same calcium hydroxide were added and allowed to mix in for 10 minutes. Then 1.45 grams of glacial acetic acid were added followed by 24.76 grams of 12-hydroxystearic acid. The grease was stirred at 190 F to 200 F. As the grease thickened, 49.65 grams of the same paraffinic base oil were added, followed shortly by another 54.28 grams of the same base oil. Then, 8.50 grams of boric acid were mixed in 30 grams of hot water and the mixture was added to the grease. After allowing the boric acid to react, 16.25 grams of a 75% solution of phosphoric acid in water were slowly added and allowed to mix in and react. Another 49.47 grams of paraffinic base oil were added as the grease continued to become harder. The mixture was then heated with an electric heating mantle while continuing to stir. When the grease reached 300 F, 20.64 grams of a styrene-alkylene copolymer were added as a crumb-formed solid. The grease was further heated to a target temperature of 390 F. However, the top temperature was overshot to a value of 429 F. The heating mantle was removed and the grease was allowed to cool by continuing to stir in open air. The polymer was melted and fully dissolved in the grease mixture when the maximum temperature had been reached. When the grease cooled to 300 F, 30.29 grams of food grade anhydrous calcium sulfate having a mean particle size below 5 microns were added. When the temperature of the grease cooled to 200 F, 2.23 grams of an aryl amine antioxidant and 4.18 grams of a polyisobutylene polymer were added. An additional 49.92 grams of the same paraffinic base oil were added.

Mixing continued until the grease reached a temperature of 170 F. The grease was then removed from the mixer and given three passes through a three-roll mill to achieve a final smooth homogenous texture. The grease had a worked 60 stroke penetration of 281. The percent overbased oil-soluble calcium sulfonate in the final grease was 20.49%. The dropping point was >650 F. As can be seen, the thickener yield of this grease was superior to either of the previous two example greases. Using the customary inverse linear relationship between worked penetration and percent overbased calcium sulfonate concentration, this example grease would have had a percent overbased calcium sulfonate concentration of 19.85% if additional base oil had been added to bring the worked penetration to the same value as the previous Example 1B grease. This result is even more remarkable since this Example 2 grease was overheated by about 29 F, an effect known to have a potentially deleterious effect on thickener yield. The amount of sodium hydroxide based on its initial, unreacted weight in the final grease product was 0.06%. It should be understood that references to the percentage of alkali metal hydroxide in final greases of the invention refer to the amount of alkali metal hydroxide added as an ingredient in making the grease, since the alkali metal hydroxide will react with complexing acids to form a salt and will not be present as the initial, unreacted hydroxide in the final grease. However, for ease of reference, its concentration in the final greases are expressed in terms of the amount of alkali metal hydroxide added as an ingredient relative to the weight of the final grease product.

Example 3 (Embodiment of Alkali/Delayed Addition Method)

Another calcium sulfonate complex grease was made in like manner with the previous Example 2 grease. The only significant difference was that the initial portions of complexing acids acetic acid and 12-hydroxystearic acid were added at the beginning of the process while the mixture was still at ambient laboratory temperature (prior to any heating). Like the previous Example 2 grease, this grease used an embodiment of the alkali/delayed addition method. Additionally, care was taken to insure that the batch was not overheated during the final heating step.

The grease of Example 3 was made as follows: 240.31 grams of 400 TBN overbased oil-soluble calcium sulfonate were added to an open mixing vessel followed by 345.09 grams of a solvent neutral group 1 paraffinic base oil having a viscosity of about 600 SUS at 100 F, and 10.03 grams of PAO having a viscosity of 4 cSt at 100 C. The 400 TBN overbased oil-soluble calcium sulfonate was a poor quality calcium sulfonate similar to the one previously described and used Examples 10 and 11 of U.S. patent application Ser. No. 13/664,768. Mixing without heat began using a planetary mixing paddle. Then 21.83 grams of a primarily C12 alkylbenzene sulfonic acid were added. After mixing for 20 minutes, 46.03 grams of calcium hydroxyapatite with a mean particle size below 5 microns and 3.30 grams of food grade purity calcium hydroxide having a mean particle size below 5 microns were added and allowed to mix in for 30 minutes. Then 0.76 grams of glacial acetic acid and 9.80 grams of 12-hydroxystearic acid were added and allowed to mix in for 15 minutes. Then 50.29 grams of finely divided calcium carbonate with a mean particle size below 5 microns were added and allowed to mix in for 5 minutes. Then 35.0 grams water into which 0.40 grams powdered sodium hydroxide had been dissolved were added. The mixture was heated until the temperature reached 190 F to 200 F (a first temperature adjustment delay period). During the heating to this temperature range, an appearance of whipped cream became evident when the temperature reached about 150 F. The whipped cream appearance subsided shortly after reaching the 190 to 200 F temperature range. Upon reaching the 190-200 F temperature range, 24.17 grams of hexylene glycol were added (no holding delay period). This amount corresponds to about the total amount of hexylene glycol that was added in the two separate portions in the previous example grease. However, in this example grease, it was added all at once since it appears that the addition of the alkali metal hydroxide with water modifies the conversion process so that additional non-aqueous converting agent may sometimes be required. An additional 20 ml water was also added, and the mixture was stirred for about one hour after which visible conversion occurred.

An additional 10 ml water was then added followed by two nearly equal portions of the same paraffinic base oil totaling 99.73 grams. This was done to prevent the continually thickening grease from becoming so heavy that it could not be effectively mixed. Fourier Transform Infrared (FTIR) spectroscopy indicated that the conversion of the amorphous calcium carbonate to crystalline calcium carbonate (calcite) had occurred. Then 6.75 grams of the same calcium hydroxide were added and allowed to mix in. An additional 30 ml of water were added to replace water that had been lost due to evaporation. Then another 55.22 grams of the same base oil were added as the grease mixture continued to thicken. Another 1.47 grams of glacial acetic acid were added followed by 24.70 grams of 12-hydroxystearic acid. The grease was then mixed for 15 minutes. The grease mixture continued to thicken, so 43.38 grams followed by another 53.97 grams of the same base oil were added.

Then 8.49 grams of boric acid were mixed in 30 ml of hot water and the mixture was added to the grease. After allowing the boric acid to react, 16.30 grams of a 75% solution of phosphoric acid in water were slowly added and allowed to mix in and react. The mixture was then heated with an electric heating mantle while continuing to stir. When the grease reached 300 F, 20.24 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 30.39 grams of food grade anhydrous calcium sulfate having a mean particle size below 5 microns were added. When the temperature of the grease cooled to 200 F, 2.06 grams of an aryl amine antioxidant and 4.46 grams of a polyisobutylene polymer were added. Three sequential portions of the same base oil totaling 132.79 grams were added and allowed to mix into the grease. Mixing continued until the grease reached a temperature of 170 F. The grease was then removed from the mixer and given three passes through a three-roll mill to achieve a final smooth homogenous texture.

The final grease in Example 3 had a worked 60 stroke penetration of 282. The percent overbased oil-soluble calcium sulfonate in the final grease was 19.20%. The dropping point was >650 F. As can be seen, this grease had an improved thickener yield compared to the greases of Examples 1A and 1B. In fact, this grease had an improved yield compared to every example grease in the '473 application, the '768 application, and U.S. Pat. No. 9,273,265. This is believed to be the best thickener yield ever achieved for a calcium sulfonate complex grease in an open mixer/kettle (non-pressurized) system that has been documented in the open literature. When made in a closed, pressurized kettle, it is believed that the thickener yield will be even better than 19.2%

Example 4 (Baseline Example—No Alkali Metal Hydroxide, No Delay Period)

Another calcium sulfonate complex grease was made in like manner with the previous example greases, except that a different base oil was used, a different non-aqueous converting agent was used, boric acid was not used, no alkali metal hydroxide was added, and there was no delay period between the addition of water and the non-aqueous converting agent. This example grease serves as a baseline for comparison with other example greases described herein where an alkali metal hydroxide was added and there was at least one delay period between the addition of water and a non-aqueous converting agent.

The grease of Example 4 was made as follows: 297.25 grams of 400 TBN overbased oil-soluble calcium sulfonate were added to an open mixing vessel followed by 373.60 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined in the '768 application. Mixing without heat began using a planetary mixing paddle. Then 26.99 grams of a primarily C12 alkylbenzene sulfonic acid were added. After mixing for 20 minutes, 50.58 grams of calcium hydroxyapatite with a mean particle size below 5 microns and 4.06 grams of food grade purity calcium hydroxide having a mean particle size below 5 microns were added and allowed to mix in for 30 minutes. Then 0.96 grams of glacial acetic acid and 11.94 grams of 12-hydroxystearic acid were added and allowed to mix in for 10 minutes. Then 55.19 grams of finely divided calcium carbonate with a mean particle size below 5 microns were added and allowed to mix in for 5 minutes. Then 37.2 grams water and 14.89 grams of propylene glycol (as the non-aqueous converting agent) were added, without any delay period. The mixture was heated until the temperature reached 190 to 200 F. Conversion and visible thickening began before reaching the target temperature range. The temperature was held between 190 F and 200 F for one hour and 10 minutes. During that time another 15 ml water were added to replace water that had been loss due to evaporation.

After the one hour and 10 minutes, Fourier Transform Infrared (FTIR) spectroscopy indicated that the conversion of the amorphous calcium carbonate to crystalline calcium carbonate (calcite) had occurred. An additional 54.07 grams of the same base oil were added due to the thickening that had occurred. Then 25 ml of water and 8.35 grams of the same calcium hydroxide were added and allowed to mix in for 10 minutes. Then 1.82 grams of glacial acetic acid were added followed by 30.60 grams of 12-hydroxystearic acid. After these two complexing acids had reacted, another 52.86 grams of the same base oil were added due to the increased hardness of the grease mixture. Then 20.27 grams of a 75% solution of phosphoric acid in water were slowly added and allowed to mix in and react. The mixture was then heated with an electric heating mantle while continuing to stir. When the grease reached 300 F, 2.86 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.10 grams of food grade anhydrous calcium sulfate having a mean particle size below 5 microns were added. When the temperature of the grease cooled to 200 F, 5.60 grams of a mixture of aryl amine and high molecular weight phenolic antioxidants and 5.50 grams of an amine phosphate antioxidant/anti-rust additive were added. An additional 50.70 grams of the same base oil were added followed by yet another 29.39 grams of the same base oil. Mixing continued until the grease reached a temperature of 170 F. The grease was then removed from the mixer and given three passes through a three-roll mill to achieve a final smooth homogenous texture. The grease had a worked 60 stroke penetration of 281. The percent overbased oil-soluble calcium sulfonate in the final grease was 26.29%. The dropping point was >650 F.

Example 5 (Embodiment of Alkali/Delayed Addition Method)

Another calcium sulfonate complex grease was made in like manner with the previous Example 4 grease, except that an alkali metal hydroxide was added and there was a delay between the addition of water and the non-aqueous converting agent. The alkali metal hydroxide used was sodium hydroxide, and its concentration in the final grease was 0.03%. Also, the amount of non-aqueous converting agent (propylene glycol) was approximately doubled compared to the previous Example 4 grease, in accordance with what was observed in the earlier Examples 2 and 3 greases where embodiments of the alkali/delayed addition method were used.

The grease in Example 5 was made as follows: 298.15 grams of 400 TBN overbased oil-soluble calcium sulfonate were added to an open mixing vessel followed by 360.45 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by the 768 application. Mixing without heat began using a planetary mixing paddle. Then 27.10 grams of a primarily C12 alkylbenzene sulfonic acid were added. After mixing for 20 minutes, 50.61 grams of calcium hydroxyapatite with a mean particle size below 5 microns and 4.09 grams of food grade purity calcium hydroxide having a mean particle size below 5 microns were added and allowed to mix in for 30 minutes. Then 0.96 grams of glacial acetic acid and 11.92 grams of 12-hydroxystearic acid were added and allowed to mix in for 15 minutes. Then 55.04 grams of finely divided calcium carbonate with a mean particle size below 5 microns were added and allowed to mix in for 5 minutes. Then 39.1 grams water into which 0.44 grams powdered sodium hydroxide had been dissolved were added. The mixture was heated with continued mixing until the temperature reached 190 to 200 F (a first temperature adjustment delay period). It was noted that when the temperature had reached about 170 F, a whipped cream appearance was observed. After reaching 190 to 200 F, an additional 20 ml water was added to replace water that had been lost due to evaporation. After mixing at 190 to 200 F for 35 minutes (a first holding delay period), 29.88 grams of propylene glycol were added and it was observed that the whipped cream appearance had subsided prior to the addition of the non-aqueous converting agent. After about 10 minutes visible conversion and thickening began to be observed. As the grease continued to thicken, 51.33 grams of the same base oil were added along with 5 ml water. Eventually, another 51.25 grams of the same base oil were added to prevent the grease from becoming excessively hard. When Fourier Transform Infrared (FTIR) spectroscopy indicated that nearly all water was gone, an additional 40 nil water was added.

After about 2 hours at 190 to 200 F (two hours after adding the propylene glycol), Fourier Transform Infrared (FTIR) spectroscopy indicated that the conversion of the amorphous calcium carbonate to crystalline calcium carbonate (calcite) had occurred. Then 40 ml of water and 8.12 grams of the same calcium hydroxide were added and allowed to mix in for 10 minutes. Another 52.07 grams of the same base oil were added as the grease continued to thicken. Then 2.85 grams of glacial acetic acid were added followed by 31.35 grams of 12-hydroxystearic acid. After these two complexing acids had reacted, another 52.11 grams of the same base oil were added due to the increased hardness of the grease mixture. Then another 20 ml water was added followed by another 54.11 grams of the same base oil. Then 20.14 grams of a 75% solution of phosphoric acid in water were slowly added and allowed to mix in and react. As the grease continued to become even harder another 52.50 grams of the same base oil were added. The mixture was then heated with an electric heating mantle while continuing to stir. When the grease reached 300 F, 2.75 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.16 grams of food grade anhydrous calcium sulfate having a mean particle size below 5 microns were added. When the temperature of the grease cooled to 200 F, 5.62 grams of a mixture of aryl amine and high molecular weight phenolic antioxidants and 5.68 grams of an amine phosphate antioxidant/anti-rust additive were added. Three portions of the same base oil totaling 107.41 grams were added. Mixing continued until the grease reached a temperature of 170 F. The grease was then removed from the mixer and given three passes through a three-roll mill to achieve a final smooth homogenous texture. The grease had a worked 60 stroke penetration of 288. The percent overbased oil-soluble calcium sulfonate in the final grease was 21.78%. The dropping point was >650 F. As can be seen, the thickener yield of this grease was much improved compared to the previous Example 4 grease, demonstrating again the remarkable effect of an embodiment of the alkali/delayed addition method.

Example 6 (Embodiment of Alkali/Delayed Addition Method)

Another calcium sulfonate complex grease was made in like manner with the previous Example 5 grease, except that the amount of sodium hydroxide was doubled. The sodium hydroxide concentration in the final grease was 0.06%. The grease was made as follows: 297.40 grams of 400 TBN overbased oil-soluble calcium sulfonate were added to an open mixing vessel followed by 360.93 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by the 768 application. Mixing without heat began using a planetary mixing paddle. Then 27.13 grams of a primarily C12 alkylbenzene sulfonic acid were added. After mixing for 20 minutes, 50.63 grams of calcium hydroxyapatite with a mean particle size below 5 microns and 4.20 grams of food grade purity calcium hydroxide having a mean particle size below 5 microns were added and allowed to mix in for 30 minutes. Then 0.95 grams of glacial acetic acid and 11.92 grams of 12-hydroxystearic acid were added and allowed to mix in for 15 minutes. Then 55.14 grams of finely divided calcium carbonate with a mean particle size below 5 microns were added and allowed to mix in for 5 minutes. Then 39.2 grams water into which 0.88 grams powdered sodium hydroxide had been dissolved were added. The mixture was heated with continued mixing until the temperature reached 190 to 200 F (a first temperature adjustment delay period). It was noted that when the temperature had reached about 184 F, a whipped cream appearance was observed. After mixing at 190 to 200 F for 35 minutes (a first holding delay period), an additional 20 ml water were added to replace water that had been lost due to evaporation. Shortly thereafter, the whipped cream appearance had subsided, and 30.25 grams of propylene glycol were added as the non-aqueous converting agent. Visible conversion and thickening had begun after 20 minutes. Another 10 ml of water were added due to evaporative loss.

As the grease continued to thicken, 51.96 grams of the same base oil were added followed by another 57.48 grams of the same base oil. When the conversion of the amorphous calcium carbonate to crystalline calcium carbonate (calcite) and the thickening process appeared to be completed, 8.12 grams of the same calcium hydroxide were added and allowed to mix in for 10 minutes. Another 51.85 grams of the same base oil were added as the grease continued to thicken. Then 1.83 grams of glacial acetic acid were added followed by 30.54 grams of 12-hydroxystearic acid. After these two complexing acids had reacted, two more portions of the same base oil totaling 107.53 grams were added due to the increased hardness of the grease mixture. Then another 10 ml water were added followed by 20.30 grams of a 75% solution of phosphoric acid in water that was slowly added and allowed to mix in and react. As the grease continued to become even harder two portions of the same base oil totaling 99.63 grams were added. The mixture was then heated with an electric heating mantle while continuing to stir. When the grease reached 300 F, 2.91 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.11 grams of food grade anhydrous calcium sulfate having a mean particle size below 5 microns were added. When the temperature of the grease cooled to 200 F, 5.78 grams of a mixture of aryl amine and high molecular weight phenolic antioxidants and 5.78 grams of an amine phosphate antioxidant/anti-rust additive were added. Three portions of the same base oil totaling 114.78 grams were added. Mixing continued until the grease reached a temperature of 170 F. The grease was then removed from the mixer and given three passes through a three-roll mill to achieve a final smooth homogenous texture. The grease had a worked 60 stroke penetration of 295. The percent overbased oil-soluble calcium sulfonate in the final grease was 20.78%. The dropping point was >650 F. As can be seen, the thickener yield of this grease was much improved compared to the previous Example 4 grease, demonstrating yet again the remarkable effect of an embodiment of the alkali/delayed addition method. Using the customary inverse linear relationship between worked penetration and percent overbased calcium sulfonate concentration, this example grease would have had a percent overbased calcium sulfonate concentration of 21.3% if base oil had been withheld to bring the worked penetration to the same value as the previous Example 5 grease. Therefore, it appears that doubling the amount of sodium hydroxide in this Example 6 grease imparted, at best, a minor further improvement on thickener yield when compared to the previous Example 5 grease.

Example 7 (Embodiment of Alkali/Delayed Addition Method)

Another calcium sulfonate complex grease was made in like manner with the previous Example 6 grease. The only significant difference between this grease and the previous Example 6 grease was that this grease was held at 160 to 170 F for one hour during the initial heating period. The grease was made as follows: 297.79 grams of 400 TBN overbased oil-soluble calcium sulfonate were added to an open mixing vessel followed by 362.02 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by the 768 application. Mixing without heat began using a planetary mixing paddle. Then 27.01 grams of a primarily C12 alkylbenzene sulfonic acid were added. After mixing for 20 minutes, 50.64 grams of calcium hydroxyapatite with a mean particle size below 5 microns and 4.14 grams of food grade purity calcium hydroxide having a mean particle size below 5 microns were added and allowed to mix in for 30 minutes. Then 0.94 grams of glacial acetic acid and 11.92 grams of 12-hydroxystearic acid were added and allowed to mix in for 15 minutes. Then 55.37 grams of finely divided calcium carbonate with a mean particle size below 5 microns were added and allowed to mix in for 5 minutes. Then 39.1 grams water into which 0.88 grams powdered sodium hydroxide had been dissolved were added. The mixture was heated with continued mixing until the temperature reached 160 to 170 F (a first temperature adjustment delay period). During this time, it was noted that a whipped cream appearance developed. After mixing at 160 to 170 F for one hour (a first holding delay period), the mixture was heated to 190 to 200 F (a second temperature adjustment delay period), and 30.14 grams of propylene glycol were added as the non-aqueous converting agent.

Visible conversion and thickening had begun after 40 minutes. Then another 30 ml of water were added due to evaporative loss. As the grease continued to thicken, 53.10 grams of the same base oil were added. After 25 minutes, another 20 ml water and 51.91 grams of the same base oil were added. Then after 10 more minutes, another 10 ml water and 56.33 grams of the same base oil were added. After another 25 minutes, when the conversion of the amorphous calcium carbonate to crystalline calcium carbonate (calcite) and the thickening process appeared to be completed, 8.18 grams of the same calcium hydroxide and another 30 ml water were added and allowed to mix in for 10 minutes. Then 1.84 grams of glacial acetic acid were added followed by 30.57 grams of 12-hydroxystearic acid. After these two complexing acids had reacted, two more portions of the same base oil totaling 105.14 grams were added due to the increased hardness of the grease mixture. Then 20.22 grams of a 75% solution of phosphoric acid in water were slowly added and allowed to mix in and react. As the grease continued to become even harder 55.31 grams of the same base oil were added. The mixture was then heated with an electric heating mantle while continuing to stir. When the grease reached 300 F, 2.77 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air.

When the grease cooled to 300 F, 33.21 grams of food grade anhydrous calcium sulfate having a mean particle size below 5 microns were added. When the temperature of the grease cooled to 200 F, 5.61 grams of a mixture of aryl amine and high molecular weight phenolic antioxidants and 5.90 grams of an amine phosphate antioxidant/anti-rust additive were added. Mixing continued until the grease reached a temperature of 170 F. The grease was then removed from the mixer and given three passes through a three-roll mill to achieve a final smooth homogenous texture. The grease had a worked 60 stroke penetration of 309. The percent overbased oil-soluble calcium sulfonate in the final grease was 23.43%. The dropping point was >650 F.

Using the customary inverse linear relationship between worked penetration and percent overbased calcium sulfonate concentration, this Example 7 grease would have had a percent overbased calcium sulfonate concentration of 25.76% if less base oil had been added so as to bring the worked penetration to the same value as the previous Example 4 grease where there was no alkali metal hydroxide added and no delay period. By comparing this value to the results of the Examples 4, 5 and 6 greases, it is apparent that most of the yield improvement effect of this Example 7 grease was eliminated by the having a first holding delay period at a first temperature range of 160 to 170 F prior to heating to 190 to 200. In Examples 12 and 17 of the '476 application, having a first holding delay period at a first temperature range of 160 to 170 F prior to heating to 190 to 200 F was shown to improve thickener yield (20.36% and 20.59%, respectively) when there was no alkali metal hydroxide added, although the first holding delay period in those examples was 2.5 hours. By comparison to the example greases in this application, it appears that the addition of a very small amount of alkali metal hydroxide (such as 0.07% by weight of the final grease of Example 7) does have an impact on the conversion process and that it is beneficial to utilize an embodiment of the alkali/delayed addition method, but that the benefits of specific combinations of delay periods in the '476 application are not necessarily achieved when combined with the addition of an alkali metal hydroxide. This result is unexpected and surprising. While the Example 7 grease does show some thickener yield improvement compared to the baseline Example 4 grease, most of the yield improvement seen in the Example 5 and 6 greases are not observed because of the specific combination delay periods and temperature ranges in Example 7. Thus, when an alkali metal hydroxide is added, it is most preferred to not heat the grease to a first temperature range of 160 to 170 F with any holding delay period at that first temperature range as part of the delayed non-aqueous converting agent method.

Example 8 (Embodiment of Alkali/Delayed Addition Method)

Another calcium sulfonate complex grease was made in like manner with the previous Example 6 grease, except that lithium hydroxide monohydrate was used as the added alkali metal hydroxide instead of sodium hydroxide. The lithium hydroxide concentration based on the monohydrate form in the final grease was 0.06%. The grease was made as follows: 298.61 grams of 400 TBN overbased oil-soluble calcium sulfonate were added to an open mixing vessel followed by 362.54 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by the '768 application. Mixing without heat began using a planetary mixing paddle. Then 27.03 grams of a primarily C12 alkylbenzene sulfonic acid were added. After mixing for 20 minutes, 50.62 grams of calcium hydroxyapatite with a mean particle size below 5 microns and 4.11 grams of food grade purity calcium hydroxide having a mean particle size below 5 microns were added and allowed to mix in for 30 minutes. Then 0.97 grams of glacial acetic acid and 11.96 grams of 12-hydroxystearic acid were added and allowed to mix in for 15 minutes. Then 55.05 grams of finely divided calcium carbonate with a mean particle size below 5 microns were added and allowed to mix in for 5 minutes. Then 39.55 grams of water into which 0.88 grams powdered lithium hydroxide monohydrate had been dissolved were added. The mixture was heated with continued mixing until the temperature reached 190 to 200 F (a first temperature adjustment delay period). It was noted that when the temperature had reached about 170 F, a whipped cream appearance was observed. After mixing at 190 to 200 F for 45 minutes (a first holding delay period), an additional 30 ml of water were added to replace water that had been lost due to evaporation and 30.01 grams of propylene glycol were added. It was also observed at that time that the whipped cream appearance had subsided.

Visible conversion and thickening had begun after 35 minutes. Another 15 ml of water were added due to evaporative loss. As the grease continued to thicken, 58.52 grams of the same base oil were added followed by another 51.15 grams of the same base oil. When the conversion of the amorphous calcium carbonate to crystalline calcium carbonate (calcite) and the thickening process appeared to be completed, 8.12 grams of the same calcium hydroxide were added and allowed to mix in for 10 minutes. Then 1.78 grams of glacial acetic acid were added followed by 30.53 grams of 12-hydroxystearic acid. After about 15 minutes, when these two complexing acids had appeared to have reacted, another 69.37 grams of the same base oil were added to prevent the grease from becoming too hard. Another 10 ml water was added. As the grease continued to harden, two more portions of the same base oil totaling 90.53 grams were added. Then another 5 ml water was added followed 20.16 grams of a 75% solution of phosphoric acid in water that was slowly added and allowed to mix in and react. As the grease continued to become even harder 38.24 grams of the same base oil were added. The mixture was then heated with an electric heating mantle while continuing to stir. When the grease reached 300 F, 2.85 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.21 grams of food grade anhydrous calcium sulfate having a mean particle size below 5 microns were added. When the temperature of the grease cooled to 200 F, 5.78 grams of a mixture of aryl amine and high molecular weight phenolic antioxidants and 6.10 grams of an amine phosphate antioxidant/anti-rust additive were added. Two more portions of the same base oil totaling 112.37 grams were added. Mixing continued until the grease reached a temperature of 170 F. The grease was then removed from the mixer and given three passes through a three-roll mill to achieve a final smooth homogenous texture. The grease had a worked 60 stroke penetration of 295. The percent overbased oil-soluble calcium sulfonate in the final grease was 21.79%. The dropping point was >650 F. As can be seen, the thickener yield of this grease was much improved compared to the previous Example 4 grease, demonstrating yet again the remarkable effect of utilizing an embodiment of the alkali/delayed addition method. By further comparing this grease to the Example 6 grease, which had the same first temperature adjustment delay period and almost the same first holding delay period (35 minutes vs. 45 minutes) it appears that the thickener yield improving effect of lithium hydroxide is not quite as effective as sodium hydroxide.

Example 9 (Embodiment of Alkali/Delayed Addition Method)

Another calcium sulfonate complex grease was made in like manner with the previous Example 6 grease, except that potassium hydroxide was used as the added alkali metal hydroxide instead of sodium hydroxide. The potassium hydroxide was introduced in the form of a 47.9% solution in water. The amount of this solution added was adjusted so as to compensate both for the concentration of potassium hydroxide and also for the difference in molecular weights between sodium and potassium hydroxide. This was done so as to provide approximately the same molar amount of added hydroxide in this grease as in the Example 6 grease. The potassium hydroxide concentration in the final grease was 0.20%. The grease was made as follows: 302.52 grams of 400 TBN overbased oil-soluble calcium sulfonate were added to an open mixing vessel followed by 357.60 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by the '768 application. Mixing without heat began using a planetary mixing paddle. Then 27.04 grams of a primarily C12 alkylbenzene sulfonic acid were added. After mixing for 20 minutes, 50.63 grams of calcium hydroxyapatite with a mean particle size below 5 microns and 4.09 grams of food grade purity calcium hydroxide having a mean particle size below 5 microns were added and allowed to mix in for 30 minutes. Then 0.96 grams of glacial acetic acid and 11.94 grams of 12-hydroxystearic acid were added and allowed to mix in for 15 minutes. Then 55.00 grams of finely divided calcium carbonate with a mean particle size below 5 microns were added and allowed to mix in for 5 minutes. Then 39.00 grams water into which 2.67 grams of a 47.9% aqueous solution of potassium hydroxide had been mixed were added.

The mixture was heated with continued mixing until the temperature reached 190 to 200 F. It was noted that when the temperature had reached about 170 to 180 F, a whipped cream appearance had developed. Heating continued until the grease reached 200 F (a first temperature adjustment delay period), and then 15 ml water and 29.72 grams of propylene glycol were added (no holding delay period). It was also observed at that time that the whipped cream appearance had subsided. Once visible conversion and thickening began, 65.89 grams of the same base oil and 10 ml water were added. As thickening continued, 36.32 grams of the same base oil and 10 ml water were added. This was followed by another 51.67 grams of the same base oil. When the conversion of the amorphous calcium carbonate to crystalline calcium carbonate (calcite) and the thickening process appeared to be completed, 8.27 grams of the same calcium hydroxide were added and allowed to mix in for 10 minutes. Then 1.79 grams of glacial acetic acid were added followed by 30.57 grams of 12-hydroxystearic acid. As these two complexing acids reacted and the grease continued to thicken, 88.20 grams of the same base oil were added followed by 5 ml water. Then as the grease became even harder, another 15.73 grams of the same base oil were added. Then 20.81 grams of a 75% solution of phosphoric acid in water were slowly added and allowed to mix in and react. As the grease continued to become even harder 51.66 grams of the same base oil were added. The mixture was then heated with an electric heating mantle while continuing to stir. When the grease reached 300 F, 2.75 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air.

When the grease cooled to 300 F, 33.19 grams of food grade anhydrous calcium sulfate having a mean particle size below 5 microns were added. When the temperature of the grease cooled to 200 F, 5.93 grams of a mixture of aryl amine and high molecular weight phenolic antioxidants and 6.78 grams of an amine phosphate antioxidant/anti-rust additive were added. Another 51.59 grams of the same base oil were added. Mixing continued until the grease reached a temperature of 170 F. The grease was then removed from the mixer and given three passes through a three-roll mill to achieve a final smooth homogenous texture. The grease had a worked 60 stroke penetration of 292. The percent overbased oil-soluble calcium sulfonate in the final grease was 23.03%. The dropping point was >650 F. As can be seen, the thickener yield of this grease was much improved compared to the previous Example 4 grease, demonstrating yet again the remarkable effect of utilizing an embodiment of the alkali/delayed addition method. By further comparing this grease to the Example 6 and 8 greases, it appears that the yield improving effect of potassium hydroxide is not quite as effective as either sodium hydroxide or lithium hydroxide. Although additional testing with other variations in the delay periods for addition of the non-aqueous converting agent may show otherwise, it is believed that sodium hydroxide is the most preferred alkali metal hydroxide, followed by lithium hydroxide and then potassium hydroxide.

Example 10 (Embodiment of Alkali/Delayed Addition Method)

Another calcium sulfonate complex grease was made in like manner with the previous Example 6 grease, except that more base oil was added initially, and the amounts of the overbased calcium sulfonate, C12 alkylbenzene sulfonic acid, propylene glycol converting agent, 12-hydroxystearic acid, and acetic acid were proportionally reduced compared to the amounts of added calcium hydroxide, calcium hydroxyapatite, added calcium carbonate, and phosphoric acid. The grease was made as follows: 233.60 grams of 400 TBN overbased oil-soluble calcium sulfonate were added to an open mixing vessel followed by 422.48 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by the '768 application. Mixing without heat began using a planetary mixing paddle. Then 21.04 grams of a primarily C12 alkylbenzene sulfonic acid were added. After mixing for 20 minutes, 50.69 grams of calcium hydroxyapatite with a mean particle size below 5 microns and 4.10 grams of food grade purity calcium hydroxide having a mean particle size below 5 microns were added and allowed to mix in for 30 minutes. Then 0.72 grams of glacial acetic acid and 9.32 grams of 12-hydroxystearic acid were added and allowed to mix in for 15 minutes. Then 55.22 grams of finely divided calcium carbonate with a mean particle size below 5 microns were added and allowed to mix in for 5 minutes. Then 39.1 grams water into which 0.88 grams powdered sodium hydroxide had been dissolved were added. The mixture was heated with continued mixing until the temperature reached 190 to 200 F (a first temperature adjustment delay period). It was noted that when the temperature had reached about 180 F, a whipped cream appearance was observed. After mixing at 190 to 200 F for 40 minutes (a first holding delay period), an additional 20 nil water were added to replace water that had been lost due to evaporation and 23.13 grams of propylene glycol were added. It was also observed at this time that the whipped cream appearance had subsided.

After 2 hours and 30 minutes, thickening was still occurring. The temperature had increased to 230 F, and FTIR showed that nearly no water remained. Another 30 ml water was added and the temperature was held at 230 F. After 30 minutes, another 35 ml water was added. After another 25 minutes, another 35 ml water was added. The temperature had decreased to about 220 F. Then, 8.22 grams of the same calcium hydroxide were added and allowed to mix in for 10 minutes. Then 1.37 grams of glacial acetic acid were added followed by 23.68 grams of 12-hydroxystearic acid. After these two complexing acids had reacted, 20.53 grams of a 75% solution of phosphoric acid in water were slowly added and allowed to mix in and react. The grease was then heated with an electric heating mantle while continuing to stir. When the grease reached 300 F, 2.79 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 33.15 grams of food grade anhydrous calcium sulfate having a mean particle size below 5 microns were added. When the temperature of the grease cooled to 200 F, 5.89 grams of a mixture of aryl amine and high molecular weight phenolic antioxidants and 5.83 grams of an amine phosphate antioxidant/anti-rust additive were added. Two portions of the same base oil totaling 103.66 grams were added. Mixing continued until the grease reached a temperature of 170 F. The grease was then removed from the mixer and given three passes through a three-roll mill to achieve a final smooth homogenous texture. The grease had a worked 60 stroke penetration of 289. The percent overbased oil-soluble calcium sulfonate in the final grease was 22.76%. The dropping point was 621 F. As can be seen, the thickener yield of this grease was much improved compared to the previous Example 4 baseline grease, demonstrating yet again the remarkable effect of an embodiment of the alkali/delayed addition method.

The results and processes used in Examples 1-10 herein are summarized in Table 1 below. The amounts of overbased calcium sulfonate indicated in parenthesis are the amounts of overbased calcium sulfonate estimated when additional base oil is added to dilute the sample grease to achieve the same penetration as in the example number indicated after the dash, and as described above. These first ten examples taken together strongly demonstrate that thickener yield is improved by utilizing embodiments of the alkali/delayed method of the invention, particularly when calcium hydroxyapatite and added calcium carbonate are used as calcium containing bases for reaction with complexing acids as described in the '768 application. Additionally, the thickener yield is improved utilizing embodiments of the alkali/delayed method of the invention with both poor quality and good quality overbased calcium sulfonates. The complex greases also demonstrated excellent dropping points.

TABLE 1

Complex Overbased Calcium Sulfonate Grease Examples

| | Ex. No. | | | | | | | | | | |
|---|---|---|---|---|---|---|---|---|---|---|---|
| | 1A | 1B | 2 | 3 | 4 | 5 | 6 | 7 | 8 | 9 | 10 |
| % Overbased Calcium Sulfonate | 23.9 | 21.4 | 20.49 (19.85-Ex. 1B) | 19.2 | 26.29 | 21.78 | 20.78 (21.3-Ex 5) | 23.43 (25.76-Ex 4) | 21.79 | 23.03 | 22.76 |
| Quality of Calcium Sulfonate | Poor | Poor | Poor | Poor | Good | Good | Good | Good | Good | Good | Good |
| Worked 60 Penetration | 287 | 290 | 281 | 282 | 281 | 288 | 295 | 309 | 295 | 292 | 289 |
| Dropping Point, F. | >650 | >650 | >650 | >650 | >650 | >650 | >650 | >650 | >650 | >650 | 621 |
| First Temp. Adj. Delay Period | No | Yes | Yes | Yes | No | Yes | Yes | Yes | Yes | Yes | Yes |
| First Temp Range, F. | N/A | 190-200 | 190-200 | 190-200 | N/A | 190-200 | 190-200 | 160-170 | 190-200 | 190-200 | 190-200 |
| First Holding Delay Period, mins. | N/A | No | No | No | N/A | Yes, 35 | Yes, 35 | Yes, 60 | Yes, 45 | No | Yes, 40 |
| Second Temp. Adj. Delay Period, Range F. | N/A | N/A/ | N/A | No | N/A | No | No | Yes, 190-200 | No | No | No |
| Alkali Metal Hydroxide | No | No | Yes, Sodium Hydroxide | Yes, Sodium Hydroxide | No | Yes, Sodium Hydroxide | Yes, Sodium Hydroxide | Yes, Sodium Hydroxide | Yes, Lithium Hydroxide Mono-hydrate | Yes, Potassium Hydroxide | Yes, Sodium Hydroxide |

The following examples further demonstrate the superior properties of overbased calcium sulfonate greases of the present invention that can be achieved utilizing embodiments of the alkali/delayed method of the invention, including variations on the timing of adding the alkali metal hydroxide.

Example 11 (Baseline Example—No Alkali Metal Hydroxide Added, No Delay Period)

Another calcium sulfonate complex grease was made similar to an embodiment of U.S. Pat. No. 4,560,489 (issued to Witco Corporation on Dec. 24, 1985), and as described in Example 18 of the '476 application. As disclosed in the '489 patent, the sole calcium containing base added for reaction with complexing acids in this grease was calcium hydroxide. This grease serves as a baseline for the next two examples.

The grease of Example 11 was made as follows: 440.02 grams of 400 TBN overbased oil-soluble calcium sulfonate were added to an open mixing vessel followed by 390.68 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application. Then 17.76 grams of a primarily C12 alkylbenzene sulfonic acid were added. After mixing for 20 minutes, 44.41 grams water was added followed by 14.37 grams of hexylene glycol. Then the batch was heated with continued mixing until the temperature reached 190 F. When the temperature reached 190 F, 5.75 grams of glacial acetic acid were added. Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Then 15.37 grams of food grade purity calcium hydroxide having a mean particle size below 5 microns were added and allowed to mix in for 10 minutes. This calcium hydroxide was the sole added calcium containing base for reaction with complexing acids. Then 28.59 grams 12-hydroxystearic acid were added and allowed to melt and react. Then 25.33 grams boric acid was mixed with 50 ml hot water, and the mixture was added to the grease. The grease was then heated to 330 F. The heating mantle was then removed and the grease was allowed to cool by continuing to stir in open air. When the grease cooled to 170 F, it was removed from the mixer and given three passes through a three-roll mill to achieve a final smooth homogenous texture. The grease had a worked 60 stroke penetration of 291. The percent overbased oil-soluble calcium sulfonate in the final grease was 46.92%. The Dropping point was >650 F.

Example 12 (Embodiment of Alkali/Delayed Addition Method)

Another grease was made in like manner with the previous grease, except that this grease had the non-aqueous converting agent hexylene glycol delayed in its addition until the mixture had been heated to 190 to 200 F. Additionally, this grease had a small amount of sodium hydroxide dissolved in the second portion of water added at 190 to 200 F after the initial conversion had occurred, but before the calcium hydroxide, 12-hydroxystearic acid, or acetic acid was added. The sodium hydroxide concentration in the final grease was 0.08%. The grease was made as follows: 430.36 grams of 400 TBN overbased oil-soluble calcium sulfonate were added to an open mixing vessel followed by 386.79 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application. Then 17.64 grams of a primarily C12 alkylbenzene sulfonic acid were added.

After mixing for 20 minutes, 44.48 grams water was added as a converting agent. Then the batch was heated with continued mixing until the temperature reached 190 to 200 F (a first temperature adjustment delay period). When the temperature reached 190 F, 5.52 grams of glacial acetic acid were added and allowed to mix in for 5 minutes. Then 14.32 grams of hexylene glycol were added while holding the temperature at 190 to 200 F. Because the 5 minute interval between reaching the 190-200 F first temperature range and adding the non-aqueous converting agent is so short, it is not considered a holding delay period. Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. Then 15.41 grams of food grade purity calcium hydroxide having a mean particle size below 5 microns were added and allowed to mix in for 10 minutes. This calcium hydroxide was the sole added calcium containing base for reaction with complexing acids. Then 44.04 grams water (a second addition of water) into which 0.88 grams of powdered sodium hydroxide had been dissolved were added and allowed to mix into the grease. Then 28.60 grams 12-hydroxystearic acid were added and allowed to melt and react. The grease was stirred for 45 minutes, and then 25.30 grams boric acid was mixed with 50 ml hot water, and the mixture was added to the grease.

The grease was then heated to 390 to 400 F. The heating mantle was then removed and the grease was allowed to cool by continuing to stir in open air. When the grease was cooled to 200 F, 2.40 grams of an aryl amine antioxidant were added. Then two more portions of the same base oil totaling 165.54 grams were added and allowed to mix into the grease. When the grease cooled to 170 F, it was removed from the mixer and given three passes through a three-roll mill to achieve a final smooth homogenous texture. The grease had a worked 60 stroke penetration of 290. The percent overbased oil-soluble calcium sulfonate in the final grease was 39.38%. The Dropping point was >650 F. As can be seen, this grease had essentially the same worked penetration as the previous Example 11 grease. However, the thickener yield was significantly improved as indicated by the much lower percentage of overbased calcium sulfonate in this grease compared to the previous Example 11 grease.

Example 13 (Embodiment of Alkali/Delayed Addition Method)

Another grease was made in like manner with the previous grease in that the non-aqueous converting agent hexylene glycol was delayed in its addition until the mixture had been heated to 190 to 200 F (a first temperature adjustment delay period). However, in this grease the small amount of sodium hydroxide was dissolved in the initial portion of water added at ambient temperature before heating of the batch began. Once again, the sodium hydroxide concentration in the final grease was 0.08%. The grease was made as follows: 440.24 grams of 400 TBN overbased oil-soluble calcium sulfonate were added to an open mixing vessel followed by 385.62 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application. Then 17.61 grams of a primarily C12 alkylbenzene sulfonic acid were added. After mixing for 20 minutes, 44.48 grams water into which 0.88 grams of powdered sodium hydroxide were dissolved were added. Then the batch was heated with continued mixing until the temperature reached 190 to 200 F (a first temperature adjustment delay period). When the temperature reached 190 F, 5.50 grams of glacial acetic acid were added and allowed to mix in for 5 minutes. Then 14.64 grams of hexylene glycol were added while holding the temperature at 190 to 200 F. Again, because the 5 minute interval between reaching the 190-200 F first temperature range and adding the non-aqueous converting agent is so short, it is not considered a holding delay period. Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred.

Then 30.1 grams water and 15.41 grams of food grade purity calcium hydroxide having a mean particle size below 5 microns were added and allowed to mix in for 10 minutes. Again, this calcium hydroxide was the sole added calcium containing base for reaction with complexing acids. Then 28.66 grams 12-hydroxystearic acid were added and allowed to melt and react. The grease was stirred for 45 minutes, and then 25.41 grams boric acid was mixed with 50 ml hot water, and the mixture was added to the grease. The grease was then heated to 390 to 400 F. The heating mantle was then removed and the grease was allowed to cool by continuing to stir in open air. When the grease was cooled to 200 F, 2.69 grams of an aryl amine antioxidant were added. Then three more portions of the same base oil totaling 172.32 grams were added and allowed to mix into the grease.

When the grease cooled to 170 F, it was removed from the mixer and given three passes through a three-roll mill to achieve a final smooth homogenous texture. The grease had a worked 60 stroke penetration of 284. The percent overbased oil-soluble calcium sulfonate in the final grease was 38.74%. The Dropping point was >650 F. Once again, the thickener yield was significantly improved as indicated by the much lower percentage of overbased calcium sulfonate in this grease compared to the previous Example 11 grease. This example grease and the previous Example 12 grease show that the utilizing an embodiment of the alkali/delayed addition method provides very significant thickener yield improvement when using only calcium hydroxide for reaction with complexing acids (as opposed to the addition of calcium hydroxyapatite and/or added calcium carbonate in the previous examples and as disclosed in the '768 application). The thickener yield results in Example 13, where the alkali metal hydroxide was added with the initial water, are better than Example 12, where the alkali metal hydroxide was added with the second addition of water, so it is preferred to add the alkali metal hydroxide with the initial addition of water, at least when calcium hydroxide is the only calcium containing base added. However, both examples 12 and 13 show significant improvement in thickener yield compared to Example 11 where no alkali metal hydroxide was added.

It is also noted that the concentration of the non-aqueous converting agent in the Example 12 and 13 greases (both utilizing embodiments of the alkali/delayed addition method) was the same as the Example 11 baseline grease. It appears that when using the prior art calcium sulfonate grease technology disclosed in the '489 patent with calcium hydroxide as the sole added calcium containing base, in combination with an embodiment of the alkali/delayed addition method, it is not necessary to increase the amount of non-aqueous converting agents to achieve a useful grease with improved thickener yield. In contrast, an increase in the amount of non-aqueous converting agent appeared necessary in Examples 2-3 and 5-10, which utilized embodiments in combination with adding calcium hydroxyapatite and added calcium carbonate as additional calcium containing bases for reaction with complexing acids; however, the thickener yields in those examples were significantly better than in Examples 12 and 13. Because the overbased calcium sulfonate used in these greases is an expensive ingredient, it is most preferred to use embodiments of the alkali/delayed addition method in combination with added calcium hydroxyapatite and added calcium carbonate, even if it requires additional amounts of some ingredients.

Example 14 (Baseline Example, No Alkali Metal Addition and No Delay Period)

A calcium sulfonate complex grease was made according to the composition and method disclosed in U.S. Pat. No. 9,273,265, wherein added calcium carbonate is a separately added ingredient in the grease. This grease did not include the addition of an alkali metal hydroxide or any delay period. This grease along with the next example grease serves as a baseline for comparison. The grease was made as follows: 310.25 grams of 400 TBN overbased oil-soluble calcium sulfonate were added to an open mixing vessel followed by 368.14 grams of a solvent neutral group 1 paraffinic base oil having a viscosity of about 600 SUS at 100 F. The 400 TBN overbased oil-soluble calcium sulfonate was a good quality calcium sulfonate similar to the one previously described and used in Examples 4 and 12 of the '768 application. Mixing without heat began using a planetary mixing paddle. Then 31.31 grams of a primarily C12 alkylbenzene sulfonic acid were added. After mixing for 20 minutes, 75.03 grams of finely divided crystalline calcium carbonate with a mean particle size below 5 microns were added and allowed to mix in for 20 minutes. This calcium carbonate was added in addition to the amount of amorphous calcium carbonate contained in the overbased calcium sulfonate. Then 0.85 grams of glacial acetic acid and 8.09 grams of 12-hydroxystearic acid were added. The mixture was stirred for 10 minutes. Then 15.83 grams of hexylene glycol and 40.1 grams water were added (without any delay period), and the mixture was heated with continued mixing to a temperature of 190 F to 200 F. During the heating step, it was noted that the mixture visibly converted to a grease structure at about 160 F. Once the grease had reached 190 to 200 F, Fourier Transform Infrared (FTIR) spectroscopy indicated that most of the water had been lost due to evaporation. Another 20 ml water was added.

After mixing at 190 to 200 F for 45 minutes, Fourier Transform Infrared (FTIR) spectroscopy indicated that the conversion of the amorphous calcium carbonate contained in the overbased calcium sulfonate to crystalline calcium carbonate (calcite) had occurred. Then 1.57 grams of glacial acetic acid and 16.41 grams of 12-hydroxystearic acid were added and allowed to react for 30 minutes. Another 20 ml water was added. Then 16.49 grams of a 75% solution of phosphoric acid in water were slowly added and allowed to mix in and react. The grease was then heated to 390 to 400 F. The heating mantle was removed from the mixer and the grease was allowed to cool while continuing to be mixed. When the temperature was below 200 F, two more portions of the same base oil totaling 105.38 grams were added. Mixing continued until the grease reached a temperature of 170 F. The grease was then removed from the mixer and given three passes through a three-roll mill to achieve a final smooth homogenous texture. The grease had a worked 60 stroke penetration of 283. The percent overbased oil-soluble calcium sulfonate in the final grease was 32.68%. The dropping point was 617 F.

Example 15 (Baseline Example, No Alkali Metal Hydroxide Added, No Delay Period)

Another calcium sulfonate complex grease was made in the same manner and according to the same composition as the previous Example 14 grease. This Example 15 grease and the previous Example 14 grease provide a baseline for comparison for the next two greases. The grease was made as follows: 310.19 grams of 400 TBN overbased oil-soluble calcium sulfonate were added to an open mixing vessel followed by 367.82 grams of a solvent neutral group 1 paraffinic base oil having a viscosity of about 600 SUS at 100 F. The 400 TBN overbased oil-soluble calcium sulfonate was a good quality calcium sulfonate similar to the one previously described and used in Examples 4 and 12 of the 768. Mixing without heat began using a planetary mixing paddle. Then 31.28 grams of a primarily C12 alkylbenzene sulfonic acid were added. After mixing for 20 minutes, 75.31 grams of finely divided crystalline calcium carbonate with a mean particle size below 5 microns were added and allowed to mix in for 20 minutes. This calcium carbonate was added in addition to the amount of amorphous calcium carbonate contained in the overbased calcium sulfonate. Then 0.84 grams of glacial acetic acid and 8.10 grams of 12-hydroxystearic acid were added. The mixture was stirred for 10 minutes. Then 15.73 grams of hexylene glycol and 41.2 grams water were added, and the mixture was heated with continued mixing to a temperature of 190 F to 200 F. During the heating step, it was noted that the mixture visibly converted to a grease structure at about 170 F. Once the grease had reached 190 to 200 F, Fourier Transform Infrared (FTIR) spectroscopy indicated that most of the water had been lost due to evaporation. Another 20 ml water was added.

After mixing at 190 to 200 F for 45 minutes, Fourier Transform Infrared (FTIR) spectroscopy indicated that the conversion of the amorphous calcium carbonate contained in the overbased calcium sulfonate to crystalline calcium carbonate (calcite) had occurred. Then 1.57 grams of glacial acetic acid and 16.44 grams of 12-hydroxystearic acid were added and allowed to react for 30 minutes. Then 16.60 grams of a 75% solution of phosphoric acid in water was slowly added and allowed to mix in and react. The grease was then heated to 390 to 400 F. The heating mantle was removed from the mixer and the grease was allowed to cool while continuing to be mixed. When the temperature was below 200 F, two more portions of the same base oil totaling 105.79 grams were added. Mixing continued until the grease reached a temperature of 170 F. The grease was then removed from the mixer and given three passes through a three-roll mill to achieve a final smooth homogenous texture. The grease had a worked 60 stroke penetration of 280. The percent overbased oil-soluble calcium sulfonate in the final grease was 32.66%. The dropping point was 583 F. As can be seen, the thickener yield of this grease is essentially identical to the previous Example 14 grease. Together these two greases establish a baseline thickener yield for a calcium sulfonate complex grease using this particular technology, and overbased oil-soluble calcium sulfonate.

Example 16

Another Calcium Sulfonate Complex Grease was made similar to the previous two greases. However, the non-aqueous converting agent hexylene glycol was not added initially with the water. Instead it was added after the mixture had been heated to 190 to 200 F (a first temperature adjustment delay period) and held at that temperature range for one hour (a first holding delay period). No alkali metal hydroxide was added to this grease. The grease was made as follows: 310.27 grams of 400 TBN overbased oil-soluble calcium sulfonate were added to an open mixing vessel followed by 368.06 grams of a solvent neutral group 1 paraffinic base oil having a viscosity of about 600 SUS at 100 F. The 400 TBN overbased oil-soluble calcium sulfonate was a good quality calcium sulfonate similar to the one previously described and used in Examples 4 and 12 of the 768 application. Mixing without heat began using a planetary mixing paddle. Then 31.18 grams of a primarily C12 alkylbenzene sulfonic acid were added. After mixing for 20 minutes, 75.29 grams of finely divided crystalline calcium carbonate with a mean particle size below 5 microns were added and allowed to mix in for 20 minutes. This calcium carbonate was added in addition to the amount of amorphous calcium carbonate contained in the overbased calcium sulfonate. Then 0.85 grams of glacial acetic acid and 8.11 grams of 12-hydroxystearic acid were added. The mixture was stirred for 10 minutes. Then 41.2 grams water was added as a converting agent, and the mixture was heated with continued mixing to a temperature of 190 F to 200 F (a first temperature adjustment delay period). The mixture was mixed at this temperature range for one hour (a first holding delay period). During that time, Fourier Transform Infrared (FTIR) spectroscopy indicated that water was being lost due to evaporation. Another 30 ml water was added.

After the one hour at 190 to 200 F, 15.66 grams of hexylene glycol were added as the non-aqueous converting agent. The mixture visibly converted to a grease shortly after the hexylene glycol was added. After mixing at 190 to 200 F for 45 minutes, Fourier Transform Infrared (FTIR) spectroscopy indicated that the conversion of the amorphous calcium carbonate contained in the overbased calcium sulfonate to crystalline calcium carbonate (calcite) had occurred. Another 30 ml water was added followed by 1.55 grams of glacial acetic acid and 16.39 grams of 12-hydroxystearic acid. These two complexing acids were allowed to react for 30 minutes. Then 16.99 grams of a 75% solution of phosphoric acid in water were slowly added and allowed to mix in and react. The grease was then heated to 390 to 400 F. The heating mantle was removed from the mixer and the grease was allowed to cool while continuing to be mixed. When the temperature was below 200 F, two more portions of the same base oil totaling 132.34 grams were added. Mixing continued until the grease reached a temperature of 170 F. The grease was then removed from the mixer and given three passes through a three-roll mill to achieve a final smooth homogenous texture. The grease had a worked 60 stroke penetration of 286. The percent overbased oil-soluble calcium sulfonate in the final grease was 31.77%. The dropping point was >650 F. As can be seen, the thickener yield of this grease was slightly improved compared to the Example 14 and 15 greases.

Example 17 (Embodiment of the Alkali/Delayed Addition Method)

Another calcium sulfonate complex grease was made similar to the previous Example 16. However, this grease used an embodiment of the alkali/delayed addition method. The non-aqueous converting agent hexylene glycol was not added initially with the water, but was added after the mixture had been heated to 190 to 200 F (a first temperature adjustment delay period). Also, the initially added water contained a very small amount of sodium hydroxide. The sodium hydroxide concentration in the final grease was 0.08%. It should be noted that the batch size of this grease was increased by 50% compared to the Examples 14-16 greases. However, the percentages of each component and other process step details were not significantly different.

The grease was made as follows: 465.31 grams of 400 TBN overbased oil-soluble calcium sulfonate were added to an open mixing vessel followed by 367.68 grams of a solvent neutral group 1 paraffinic base oil having a viscosity of about 600 SUS at 100 F. The 400 TBN overbased oil-soluble calcium sulfonate was a good quality calcium sulfonate similar to the one previously described and used in Examples 4 and 12 of the 768. Mixing without heat began using a planetary mixing paddle. Then 46.64 grams of a primarily C12 alkylbenzene sulfonic acid were added. After mixing for 20 minutes, 112.50 grams of finely divided crystalline calcium carbonate with a mean particle size below 5 microns were added and allowed to mix in for 20 minutes. This calcium carbonate was added in addition to the amount of amorphous calcium carbonate contained in the overbased calcium sulfonate. Then 1.26 grams of glacial acetic acid and 12.20 grams of 12-hydroxystearic acid were added. The mixture was stirred for 10 minutes. Then 41.2 grams water into which 1.20 grams of powdered sodium hydroxide had been dissolved were added, and the mixture was heated with continued mixing to a temperature of 190 F to 200 F (a first temperature adjustment delay period). It was noted that some foaming began to be apparent during the heating step when the temperature reached about 176 F. When the mixture reached 190 to 200 F, 42.13 grams of hexylene glycol were added (without a holding delay period). The mixture visibly converted to a grease shortly after the hexylene glycol was added.

After mixing for about 20 minutes, another 76.61 grams of the same base oil were added due to the grease becoming extremely heavy. The grease was mixed at 190 to 200 F for another 45 minutes. During that time, Fourier Transform Infrared (FTIR) spectroscopy indicated that the water had been lost, so another 40 ml water was added. At the end of the 45 minutes of mixing, the grease had significantly thinned out. Fourier Transform Infrared Spectroscopy indicated that the conversion of the amorphous calcium carbonate to crystalline calcium carbonate (calcite) had occurred. Then 2.36 grams of glacial acetic acid and 24.58 grams of 12-hydroxystearic acid were added. These two complexing acids were allowed to react for 30 minutes. Then 24.74 grams of a 75% solution of phosphoric acid in water were slowly added and allowed to mix in and react. The grease was then heated to 390 to 400 F. The heating mantle was removed from the mixer and the grease was allowed to cool while continuing to be mixed. As the grease cooled it thickened by an extreme amount.

When the temperature was below 200 F, four portions of the same base oil totaling 284.40 grams were added. Mixing continued until the grease reached a temperature of 170 F. The grease was then removed from the mixer and given three passes through a three-roll mill to achieve a final smooth homogenous texture. The grease had a worked 60 stroke penetration of 274. The percent overbased oil-soluble calcium sulfonate in the final grease was 31.84%. The dropping point was >650 F. Using the customary inverse linear relationship between worked penetration and percent overbased calcium sulfonate concentration, this example grease would have had a percent overbased calcium sulfonate concentration of 30.52% if additional base oil had been added to bring the worked penetration to the same value as the previous Example 16 grease. Thus, the use of an embodiment of the alkali/delayed addition method in this grease did provide some improvement in thickener yield when compared to the two baseline greases of Examples 14 and 15. Nonetheless, the amount of improvement is not as significant as what was observed in some of the other example greases. Without being bound by theory, the lower amount of yield improvement provided by this grease may be due to the fact that there was no added calcium hydroxide. If the effect of the small amount of sodium hydroxide is indeed due to the rapid reaction of sodium hydroxide with complexing acids followed by metathesis of the sodium fatty acid salt with calcium hydroxide, then the absence of calcium hydroxide would certainly affect that mechanism. In the grease of Example 17, the metathesis reaction would have to be between the sodium fatty acid salt and calcium carbonate, which may not be as facile.

The results and processes used in Examples 11-17 herein are summarized in Table 2 below. All of these examples used a good quality overbased calcium sulfonate.

The following examples further demonstrate the superior properties of overbased calcium sulfonate greases of the present invention that can be achieved with embodiments of the alkali/delayed addition method, including variations on the timing of the alkali metal addition.

Example 18 (Baseline Example—No Alkali Metal Hydroxide Added, No Delay Period)

A calcium sulfonate complex grease was made according to the scope of U.S. Pat. Nos. 5,308,514 and 5,338,467 (issued to Witco Corporation on May 3, 1994 and Aug. 16, 1994, respectively), where at least a portion of the long chain fatty acid is added prior to conversion and may act as a converting agent and where only calcium hydroxide or calcium oxide is added as a calcium containing base for reacting with complexing acids (no calcium hydroxyapatite or added calcium carbonate, as in the 768 application). This example is the same as Example 6A from the '476 application, where 54.1% of the total amount of 12-hydroxystearic acid and all of the glacial acetic acid were added before conversion. The remaining amount of 12-hydroxystearic acid was added after conversion followed by calcium hydroxide and a boric acid water mixture. Additionally, no alkali metal hydroxide was added and there was no delay between the addition of water and the primary non-aqueous converting agent. This grease serves as a base line for comparison.

The grease of Example 18 was made as follows: 380.73 grams of 400 TBN overbased oil-soluble calcium sulfonate were added to an open mixing vessel followed by 604.50 grams of a solvent neutral group 1 paraffinic base oil having a viscosity of about 600 SUS at 100 F. Mixing without heat began using a planetary mixing paddle. The 400 TBN

TABLE 2

Complex Overbased Calcium Sulfonate Grease Examples

| | Example No. | | | | | | |
|---|---|---|---|---|---|---|---|
| | 11 | 12 | 13 | 14 | 15 | 16 | 17 |
| % Overbased Calcium Sulfonate | 46.92 | 39.38 | 38.74 | 32.68 | 32.66 | 31.77 | 31.84 (30.52-Ex. 16) |
| Quality of Overbased Calcium Sulfonate | Good | Good | Good | Good | Good | Good | Good |
| Worked 60 Penetration | 291 | 290 | 284 | 283 | 280 | 286 | 274 |
| Dropping Point, F. | >650 | >650 | >650 | 617 | 583 | >650 | >650 |
| Calcium Containing Base | Calcium Hydroxide | Calcium Hydroxide | Calcium Hydroxide | Calcium Carbonate | Calcium Carbonate | Calcium Carbonate | Calcium Carbonate |
| Alkali Metal Hydroxide Added | No | Yes, Sodium Hydroxide Added with 2nd addition of Water | Yes, Sodium Hydroxide Added with 1st addition of Water | No | No | No | Yes, Sodium Hydroxide, added with 1st addition of water |
| First Temp. Adj. Delay Period | No | Yes | Yes | No | No | Yes | Yes |
| First Temp Range, F. | N/A | 190-200 | 190-200 | N/A | N/A | 190-200 | 190-200 |
| First Holding Delay Duration, mins. | N/A | No | No | N/A | N/A | Yes, 60 | No |

overbased oil-soluble calcium sulfonate was a good quality calcium sulfonate similar to the one previously described and used in Examples 4 and 12 of the '768 application. Then 21.66 grams of a primarily C12 alkylbenzene sulfonic acid were added. After mixing for 20 minutes, 21.59 grams of 12-hydroxystearic acid were added followed by 18.16 grams of hexylene glycol and 38.0 grams water. After mixing for 10 minutes, 2.40 grams of glacial acetic acid were added. Then the batch was heated with continued mixing until the temperature reached 190 F. The temperature was held between 190 F and 200 F for 45 minutes. The batch was mixed until Fourier Transform Infrared (FTIR) spectroscopy indicated that the conversion of the amorphous calcium carbonate contained in the overbased calcium sulfonate to crystalline calcium carbonate (calcite) had occurred.

An additional 249.94 grams of the paraffinic base oil were added followed by 18.21 grams 12-hydroxystearic acid. This was allowed to mix in for 15 minutes while keeping the temperature between 190 F and 200 F. Then 38.02 grams of finely divided food grade purity calcium hydroxide having a mean particle size less than 5 microns were mixed with 50 grams of water, and the mixture was added to the grease. Then 23.02 grams boric acid was mixed with 50 ml hot water, and the mixture was added to the grease. The grease was then heated to 390 F. The heating mantle was then removed and the grease was allowed to cool by continuing to stir in open air. When the grease cooled to 170 F, it was removed from the mixer and given three passes through a three-roll mill to achieve a final smooth homogenous texture. The grease had a worked 60 stroke penetration of 339. The percent overbased oil-soluble calcium sulfonate in the final grease was 27.62%. The Dropping Point was 640 F.

Example 19 (Delayed Addition Method of '476 Application, No Alkali Metal Hydroxide Added)

Another calcium complex grease was made using the same equipment, raw materials, amounts, and manufacturing process as the Example 18 grease, except there was a first temperature adjustment delay period (heating to 190-200) and a first holding delay period (holding at 190-200 for one hour) between the addition of water and hexylene glycol as the non-aqueous converting agent. No alkali metal hydroxide was added. When the hexylene glycol was added, the grease was held at 190 F to 200 F until conversion appeared to be complete. Then the remaining process was the same as the previous Example 18 grease. The final grease had a worked 60 stroke penetration of 281. The percent overbased oil-soluble calcium sulfonate in the final grease was 27.60%. The dropping point was >650 F. As can be seen, the grease of this example had an improved thickener yield compared to the grease of the previous Example 18 as evidenced by the much firmer penetration despite having essentially the same percentage overbased oil-soluble calcium sulfonate. In fact, using the customary inverse linear relationship between worked penetration and percent overbased calcium sulfonate concentration, the predicted percentage of overbased calcium sulfonate in the Example 19 grease would be 24.2% if it was diluted with sufficient base oil to obtain the same worked penetration of the Example 18 grease.

Example 20 (Embodiment of Alkali/Delayed Addition Method)

Another grease was made in like manner with the previous Example 19 grease in that the non-aqueous converting agent hexylene glycol was delayed in its addition until the mixture had been heated to 190 to 200 F. However, in this grease a small amount of sodium hydroxide was dissolved in the initial portion of water added at ambient temperature before heating of the batch began. Also, there was no one hour holding delay period once the 190 to 200 F temperature range had been reached. Instead, the hexylene glycol was added as soon as that temperature range was achieved. This was done in accordance to what was observed in the previous Example 7 grease where it was observed that a holding temperature delay for the non-aqueous converting agent did not provide the highest thickener yield improvement when an alkali metal hydroxide was also added.

The grease was made as follows: 380.79 grams of 400 TBN overbased oil-soluble calcium sulfonate were added to an open mixing vessel followed by 589.33 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application). Then 21.63 grams of a primarily C12 alkylbenzene sulfonic acid were added. After mixing for 20 minutes, 21.58 grams of 12-hydroxystearic acid were added followed by 38.14 grams water into which 0.85 grams of powdered sodium hydroxide had been dissolved. After mixing for 10 minutes, 2.40 grams of glacial acetic acid were added. Then the batch was heated with continued mixing until the temperature reached 190 to 200 F (a first temperature adjustment period). It was noted that when the temperature had reached about 180 F, foaming was observed. When the temperature reached 190 to 200 F, 27.57 grams of hexylene glycol were added (without any holding delay). After about 10 minutes, the batch visibly converted to a grease structure.

The batch was then mixed for an additional 45 minutes until Fourier Transform Infrared (FTIR) spectroscopy indicated that the conversion of the amorphous calcium carbonate to crystalline calcium carbonate (calcite) had occurred. During the 45 minutes of mixing, an additional 40 ml water was added to replace water that was lost due to evaporation. Then, 18.27 grams 12-hydroxystearic acid were added and allowed to mix in for 15 minutes while keeping the temperature at between 190 F and 200 F. Then 38.04 grams of finely divided food grade purity calcium hydroxide having a mean particle size less than 5 microns were mixed with 50 grams of water, and the mixture was added to the grease. Then 23.04 grams boric acid was mixed with 50 ml hot water, and the mixture was added to the grease. The grease was then heated to 390 F. The heating mantle was then removed and the grease was allowed to cool by continuing to stir in open air. During the cooling, the grease thickened significantly. Three approximately equal portions of the same base oil totaling 253.87 grams were added and allowed to mix into the grease. When the grease cooled to 170 F, it was removed from the mixer and given three passes through a three-roll mill to achieve a final smooth homogenous texture. The grease had a worked 60 stroke penetration of 280. The dropping point was >650 F. The percent overbased oil-soluble calcium sulfonate in the final grease was 27.65%. The concentration of sodium hydroxide in the final grease was 0.06%.

Example 21 (Embodiment of Alkali/Delayed Addition Method)

Another grease was made nearly identical to the previous Example 20 grease. The only significant difference was that after conversion was complete, the mixture of sodium hydroxide in water was added. Then the second portion of 12-hydroxystearic acid and the mixture of boric acid in hot water were added. The final grease had a worked 60 stroke penetration of 285. The dropping point was >650 F. The percent overbased oil-soluble calcium sulfonate in the final grease was 27.40%. The concentration of sodium hydroxide in the final grease was 0.06%. As can be seen, the thickener yield of the Examples 19, 20, and 21 greases were all significantly superior to the Example 18 baseline grease. However, the use of an embodiment of the alkali/delayed addition method did not provide much additional thickener yield improvement beyond what was imparted by just the delayed addition method of the '476 application, when a good quality overbased calcium sulfonate was used. This appears to indicate that the best thickener yield improvement may achieved with the alkali metal hydroxide addition and/or delayed non-aqueous converting agent method when using poor quality overbased calcium sulfonates instead of good quality overbased calcium sulfonates.

The results and processes used in Examples 18-21 herein are summarized in Table 3 below. All of these examples used a good quality overbased calcium sulfonate.

TABLE 3

Complex Overbased Calcium Sulfonate Grease Examples

| | Example No. | | | |
|---|---|---|---|---|
| | 18 | 19 | 20 | 21 |
| % Overbased Calcium Sulfonate | 27.62 | 27.6 (24.2 - Ex. 18) | 27.65 | 27.4 |
| Quality of Overbased Calcium Sulfonate | Good | Good | Good | Good |
| Worked 60 Penetration | 339 | 281 | 280 | 285 |
| Dropping Point, F. | 640 | >650 | >650 | >650 |
| Calcium Containing Base | Calcium Hydroxide | Calcium Hydroxide | Calcium Hydroxide | Calcium Hydroxide |
| Alkali Metal Hydroxide Added | No | No | Yes, Sodium Hydroxide | Yes, Sodium Hydroxide |
| First Temp. Adj. Delay Period | No | Yes | Yes | Yes |
| First Temp Range, F. | N/A | 190-200 | 190-200 | 190-200 |
| First Holding Delay Duration, mins. | | Yes, 60 | No | No |

Additional examples showing the results of an alkali metal hydroxide addition in a simple calcium sulfonate grease are found in the following examples.

Example 22 (Baseline Example—No Alkali Metal Hydroxide Added, No Delay Period)

A simple calcium sulfonate grease was made according to the scope of U.S. Pat. Nos. 3,377,283 and 3,492,231 (issued to Lubrizol Corporation on Apr. 9, 1968 and Jan. 27, 1970, respectively), without any delay or alkali metal hydroxide addition for use as a baseline for comparison for the next three greases. The grease was made as follows: 496.49 grams of 400 TBN overbased oil-soluble calcium sulfonate were added to an open mixing vessel followed by 394.45 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application. Then 20.23 grams of a primarily C12 alkylbenzene sulfonic acid were added. After mixing for 20 minutes, 44.23 grams water was added followed by 16.57 grams of hexylene glycol (the primary converting agent). Then the batch was heated with continued mixing until the temperature reached 190 F. When the temperature reached 190 F, 6.20 grams of glacial acetic acid were added. Once visible conversion to a grease structure was observed, the temperature was held between 190 F and 200 F for 45 minutes until Fourier Transform Infrared (FTIR) spectroscopy indicated that the conversion of the amorphous calcium carbonate containing in the overbased calcium sulfonate to crystalline calcium carbonate (calcite) had occurred. During this time, an additional 10 ml of water were added. The resulting grease was then heated to 330 F. The heating mantle was then removed and the grease was allowed to cool by continuing to stir in open air. When the temperature reached 200 F, 2.34 grams of an aryl amine antioxidant were added. When the grease cooled to 170 F, it was removed from the mixer and given three passes through a three-roll mill to achieve a final smooth homogenous texture. The grease had a worked 60 stroke penetration of 331. The percent overbased oil-soluble calcium sulfonate in the final grease was 53.03%, and the dropping point was >650 F.

Example 23 (Delayed Addition Method of '476 Application, No Alkali Addition)

Another simple calcium sulfonate grease was made in like manner with the previous Example 22 grease, except that there delay periods between the addition of water and the non-aqueous converting agent. No alkali metal hydroxide was added in this example. The grease was made as follows: 495.41 grams of 400 TBN overbased oil-soluble calcium sulfonate were added to an open mixing vessel followed by 391.96 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application). Then 19.65 grams of a primarily C12 alkylbenzene sulfonic acid were added. After mixing for 20 minutes, 44.42 grams of water was added. Then the mixture was heated to 160 F (a first temperature adjustment delay period) and held between 160 F and 170 F for two hours and 30 minutes (a first holding delay period). During this time, an additional 50 ml of water were added since most of the originally added water had evaporated. The batch was then heated to 190 F (a second temperature adjustment delay period), and 16.53 grams of hexylene glycol (the primary converting agent) followed by 6.34 grams of glacial acetic acid were added.

Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. During this time, an additional 10 ml of water were added. The resulting grease was then heated to 330 F. The heating mantle was then removed and the grease was allowed to cool by continuing to stir in open air. When the temperature reached 200 F, 2.32 grams of an aryl amine antioxidant were added. When the grease cooled to 170 F, it was removed from the mixer and given three passes through a three-roll mill to achieve a final smooth homogenous texture. The dropping point of the Example 21 grease was >650 F. The grease had a worked 60 stroke penetration of 290. The percent overbased oil-soluble calcium sulfonate in the final grease was 53.14%.

It is noted that this grease and the previous Example 22 grease had essentially the same percent overbased calcium sulfonate. However, the worked penetration of this grease was 41 points harder. Therefore, the delayed glycol procedure used in this grease resulted in an improved thickener yield. In fact, using the customary inverse linear relationship between worked penetration and percent overbased calcium sulfonate concentration, the predicted percentage of overbased calcium sulfonate in this Example 23 grease would be 46.6% if it was diluted with sufficient base oil to obtain the same worked penetration of the Example 22 grease. Additionally, a very high dropping point was maintained.

Example 24 (Alkali Addition and Delayed Addition)

Another simple calcium sulfonate grease was made in like manner with the previous Example 23 grease, except that a different delay period was used between the addition of water and the non-aqueous converting agent and a small amount of sodium hydroxide was added. The concentration of sodium hydroxide in the final grease was 0.09%. The grease was made as follows: 495.18 grams of 400 TBN overbased oil-soluble calcium sulfonate were added to an open mixing vessel followed by 392.56 grams of a solvent neutral group 1 paraffinic base oil having a viscosity of about 600 SUS at 100 F. Mixing without heat began using a planetary mixing paddle. The 400 TBN overbased oil-soluble calcium sulfonate was a good quality calcium sulfonate similar to the one previously described and used in Examples 4 and 12 of the '768 application. Then 20.31 grams of a primarily C12 alkylbenzene sulfonic acid were added. After mixing for 20 minutes, 0.88 grams of powdered sodium hydroxide were dissolved in 44.0 grams water, and the resulting solution was added. Then the mixture was heated to 190 F (a first temperature adjustment delay period), and 16.73 grams of hexylene glycol and 6.16 grams of glacial acetic acid were added.

Once visible conversion to a grease structure was observed, the temperature was held between 190 F and 200 F for 45 minutes until Fourier Transform Infrared (FTIR) spectroscopy indicated that the conversion of the amorphous calcium carbonate to crystalline calcium carbonate (calcite) had occurred. During this time, an additional 20 ml of water were added. The resulting grease was then heated to 330 F. The heating mantle was then removed and the grease was allowed to cool by continuing to stir in open air. When the temperature reached 200 F, 3.35 grams of an aryl amine antioxidant were added. When the grease cooled to 170 F, it was removed from the mixer and given three passes through a three-roll mill to achieve a final smooth homogenous texture. The dropping point of the Example 24 grease was 478 F. The grease had a worked 60 stroke penetration of 311. The percent overbased oil-soluble calcium sulfonate in the final grease was 52.95%.

By comparing this grease with the previous Example 23 grease, it is obvious that the benefit observed by using an embodiment of the alkali/delayed addition method in the previous grease examples is not observed in this grease. The thickener yield was significantly reduced, and the dropping point was lowered in this Example 24 grease compared to the previous Example 23 grease. Again, without being bound by theory, it appears that the addition of an alkali hydroxide improves thickener yield primarily due to reaction with complexing acids used in making complex calcium sulfonate greases, but since a simple grease does not involve the addition of complexing acids, that benefit is not achieved with simple greases and it even appears detrimental to thickener yield to add an alkali metal hydroxide to a simple grease composition. The results of Examples 22-24 are summarized in Table 4 below.

TABLE 4

Simple Overbased Calcium Sulfonate Grease Examples

| | Example No. | | |
|---|---|---|---|
| | 22 | 23 | 24 |
| % Over based Calcium Sulfonate | 53.03 | 53.14 (46.6 - Ex. 22) | 52.95 |
| Worked 60 Penetration | 331 | 290 | 311 |
| Dropping Point, F. | >650 | >650 | 478 |
| Alkali Metal Hydroxide | No | No | Yes, Sodium Hydroxide added with initial water |
| Non-Aqueous Converting Agent | Hexylene Glycol | Hexylene Glycol | Hexylene Glycol |
| Delay in Addition of Non-Aqueous Converting Agent | No | Yes | Yes |
| First Temp Range, F. | N/A | 160-170 | 190-200 |
| First Holding Duration, hr. | N/A | 2.5 | N/A |
| Second Delay Temp Range, F. | N/A | 190 | N/A |
| Second Holding Duration, hr. | N/A | N/A | N/A |

The complex grease examples show that utilizing embodiments of the alkali/delayed addition method consistently improved thickener yield regardless of which previously documented calcium sulfonate-based grease technology is used. Additionally, the thickener yield improvement is observed regardless of whether the overbased calcium sulfonate used was good or poor quality, as defined in the '768 application, although greater improvements are achieved with poor quality calcium sulfonates within the range of example compositions included herein (which is contrary to what would be expected).

Example greases made according to the alkali/delayed addition methods of the invention described above also show different physical properties compared to example greases where addition of all or some of a non-aqueous converting agent was not delayed, even though the ingredients and quantities thereof used in various comparison sets of the examples were the same or substantially similar. Using Fourier Transform Infrared Spectroscopy (FTIR) and Scanning Electron Microscopy (SEM), testing on samples of the example greases demonstrated that greases made with a delay addition according to the invention could be distinguished from those of similar composition made without the delay. There are differences in the adsorption curve profiles and differences in particle sizes and configurations, for example.

Although the examples provided herein fall primarily in the NLGI No. 1, No. 2, or No. 3 grade, with No. 2 grade being the most preferred, it should be further understood that the scope of this present invention includes all NLGI consistency grades harder and softer than a No. 2 grade. However, for such greases according to the present invention that are not NLGI No. 2 grade, their properties should be consistent with what would have been obtained if more or less base oil had been used so as to provide a No. 2 grade product, as will be understood by those of ordinary skill in the art.

While this invention deals primarily with greases made in open vessels, and the examples are all in open vessels, the complex calcium sulfonate grease compositions and methods may also be used in closed vessels where heating under pressure is accomplished. The use of such pressurized vessels may result in even better thickener yields than those described in the examples herein. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art.

As used herein, the term "thickener yield" as it applies to the subject invention shall be the conventional meaning, namely, the concentration of the highly overbased oil-soluble calcium sulfonate required to provide a grease with a specific desired consistency as measured by the standard penetration tests ASTM D217 or D1403 commonly used in lubricating grease manufacturing. In like manner, as used herein the "dropping point" of a grease shall refer to the value obtained by using the standard dropping point test ASTM D2265 as commonly used in lubricating grease manufacturing. As used herein, reference to the immediate addition of an ingredient after a temperature has been reached means that the ingredient is added as soon after reaching that temperature as is physically possible given the amount to be added and equipment being used, but if preferably within a short time, less than 10 minutes and more preferably less than 5 minutes, after the mixture reaches approximately the temperature indicated.

As used herein: (1) quantities of dispersed calcium carbonate (or amorphous calcium carbonate) or residual calcium oxide or calcium hydroxide contained in the overbased calcium sulfonate are by weight of the overbased calcium sulfonate; (2) some ingredients are added in two or more separate portions and each portion may be described as a percentage of the total amount for that ingredient; and (3) all other amounts (including total amounts) of ingredients identified by percentages or parts are the amounts added as an ingredient by weight of the final grease product, even though the particular ingredient (such as water, or calcium-containing bases or alkali metal hydroxides that react with other ingredients) may not be present in the final grease or may not be present in the final grease in the quantity identified for addition as an ingredient. As used herein "added calcium carbonate" means crystalline calcium carbonate that is added as a separate ingredient in addition to the amount of dispersed calcium carbonate contained in the overbased calcium sulfonate. As used herein "added calcium hydroxide" and "added calcium oxide" means calcium hydroxide and calcium oxide, respectively, that are added as a separate ingredient in addition to the amount of residual calcium hydroxide and/or calcium oxide that may be contained in the overbased calcium sulfonate. As used herein to describe the invention (as opposed to how the term is used in some prior art references), calcium hydroxyapatite means (1) the compound having the formula $Ca_5(PO_4)_3OH$ or (2) a mathematically equivalent formula (a) having a melting point of around 1100 C or (b) specifically excluding mixtures of tricalcium phosphate and calcium hydroxide by such equivalent formula. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

I claim:

1. A method for making a complex overbased calcium sulfonate grease comprising the steps of:

mixing an amount of overbased oil-soluble calcium sulfonate having amorphous calcium carbonate dispersed therein with a base oil, and one or more converting agents to form a pre-conversion mixture;

converting the pre-conversion mixture to a converted mixture by heating until conversion of the amorphous calcium carbonate to crystalline calcium carbonate has occurred;

mixing an amount of an alkali metal hydroxide with the pre-conversion mixture, converted mixture or both; and mixing an amount of one or more complexing acids with the pre-conversion mixture or the converted mixture or both; and wherein the amount of overbased oil-soluble calcium sulfonate is around 10% to 45%.

2. The method according to claim 1 wherein the amount of alkali metal hydroxide is around 0.005% to 5%.

3. The method according to claim 1 further comprising mixing one or more of calcium hydroxyapatite, added calcium hydroxide, added calcium oxide, added calcium carbonate, or any combination thereof with the pre-conversion mixture, converted mixture or both.

4. The method according to claim 1 wherein the alkali metal hydroxide is sodium hydroxide, lithium hydroxide, potassium hydroxide or a combination thereof.

5. The method according to claim 2 wherein the alkali metal hydroxide is sodium hydroxide and the amount of sodium hydroxide mixes is around 0.01% to 0.4%.

6. The method according to claim 1 wherein the alkali metal hydroxide is dissolved in water to form a solution and the solution is mixed with the pre-conversion mixture, converted mixture or both.

7. The method according to claim 1 wherein the overbased calcium sulfonate is a poor quality calcium sulfonate and the grease has a dropping point of at least 575 F.

8. The method according to claim 1 wherein the converting agents comprise water and one or more non-aqueous converting agents and the method further comprises:

mixing the water with the overbased calcium sulfonate and base oil to form a first mixture;

mixing at least a portion of the one or more non-aqueous converting agents with the first mixture during or after one or more delay periods to form the pre-conversion mixture.

9. The method according to claim 8 wherein the alkali metal hydroxide is dissolved in the water used as a converting agent to form a solution and the solution is mixed with the overbased calcium sulfonate and base oil to form the first mixture.

10. The method according to claim 8 wherein the alkali metal hydroxide is dissolved in a second portion of water to form a solution and the solution is mixed with the first mixture, the pre-conversion mixture, the converted mixture, or a combination thereof.

11. The method according to claim 8 wherein at least all or a portion of one complexing acid is mixed with the first mixture or pre-conversion mixture and at least all or a portion of the same or a different complexing acid is mixed with the converted mixture.

12. The method according to claim 11 wherein at least a portion of one complexing acid is mixed with the first mixture or the pre-conversion mixture prior to any heating.

13. The method according to claim 8 wherein the converting step comprises:

heating the pre-conversion mixture to a conversion temperature range of about 190 F to 230 F for an open vessel or other temperature range at which conversion occurs for a closed vessel; and maintaining the temperature in that range until conversion of the amorphous calcium carbonate to crystalline calcium carbonate has occurred.

14. The method according to claim 11 wherein the complexing acids comprise acetic acid and 12-hydroxystearic acid and wherein a portion of both acids is mixed with the first mixture or the pre-conversion mixture and another potion of both acids is mixed with the converted mixture.

15. The method according to claim 14 wherein the complexing acids further comprise boric acid, phosphoric acid, or both and wherein all of the boric acid, phosphoric acid or both are mixed with the converted mixture.

16. The method according to claim 14 wherein the non-aqueous converting agent is hexylene glycol and it is mixed with the first mixture after a temperature adjustment delay period.

17. The method according to claim 14 wherein the alkali metal hydroxide is mixed with the first mixture.

18. The method of claim 1 wherein the calcium sulfonate grease has a dropping point of at least 575 F and the amount of overbased calcium sulfonate is around 10% to 32%.

19. The method of claim 8 wherein the calcium sulfonate grease has a dropping point of at least 575 F and the amount of overbased calcium sulfonate is around 10% to 32%.

20. The method according to claim 8 further comprising adding at least a portion of one or more of the non-aqueous converting agents to one or more of the following: the first mixture before any delay period, the first mixture during or after a delay period, or the pre-conversion mixture during or after one or more delay periods.

21. The method according to claim 20 wherein acetic acid is not added as a non-aqueous converting agent during any delay period.

22. The method according to claim 8 further comprising mixing one or more of calcium hydroxyapatite, added calcium hydroxide, added calcium oxide, added calcium carbonate, or any combination thereof with the first mixture, the pre-conversion mixture, the converted mixture or any combination thereof.

23. The method according to claim 8 wherein at least one of the non-aqueous converting agents is a glycol, a glycol ether, or a glycol polyether.

24. The method according to claim 20 wherein the glycol is hexylene glycol.

25. The method according to claim 24 wherein a portion of the hexylene glycol is mixed with the first mixture prior to any delay period and another portion of the hexylene glycol is mixed to the first mixture or pre-conversion mixture after or during one or more delay periods.

26. The method according to claim 8 wherein there are at least two delay periods, wherein one of the delay periods is a temperature adjustment delay period where the first mixture or pre-conversion mixture is heated or cooled and at least one other delay period is a holding delay period wherein the first mixture or pre-conversion mixture is maintained at a temperature or within a range of temperatures for a period of time.

27. The method according to claim 8 wherein the overbased calcium sulfonate is a poor quality overbased calcium sulfonate.

28. The method according to claim 22 wherein the overbased calcium sulfonate comprises around 0% to 8% residual calcium hydroxide and/or calcium oxide and wherein no additional calcium oxide or calcium hydroxide is added as a calcium containing base for reacting with complexing acids.

29. The method according to claim 8 wherein at least one of the non-aqueous converting agents is methanol, isopropyl alcohol, or another low molecular weight alcohols.

30. The method according to claim 8 wherein methanol, isopropyl alcohol, or another low molecular weight alcohol is not used as a non-aqueous converting agent.

31. The method according to claim 1 wherein the amount of overbased calcium sulfonate is around 10% to 22%.

32. The method of claim 1 wherein at least a portion of the alkali metal hydroxide is added to the pre-conversion mixture.

33. The method of claim 1 further comprising mixing one or more of calcium containing bases for reaction with the one or more complexing acids;

wherein the one or more calcium containing bases are added to the pre-conversion mixture, the converted mixture, or both; and wherein at least a portion of the alkali metal hydroxide is added prior to the reaction between the one or more calcium containing bases and the one or more complexing acids.

34. The method of claim 1 further comprising mixing one or more of calcium containing bases for reaction with the one or more complexing acids;

wherein the one or more calcium containing bases are added to the pre-conversion mixture, the converted mixture, or both; and wherein at least a portion of the one or more calcium containing bases and at least a portion of the one or more complexing acids are added and mixed after mixing at least a portion of the alkali metal hydroxide.

35. The method of claim 1 wherein at least a portion of the alkali metal hydroxide is added to the pre-conversion mixture and at least a portion of the same or a different alkali metal hydroxide is added to the converted mixture.

* * * * *